US008655492B2

(12) United States Patent
Wakuta et al.

(10) Patent No.: US 8,655,492 B2
(45) Date of Patent: Feb. 18, 2014

(54) AIR-CONDITIONING APPARATUS CONTROL DEVICE AND REFRIGERATING APPARATUS CONTROL DEVICE

(75) Inventors: Naoki Wakuta, Chiyoda-ku (JP); Hiroyuki Hashimoto, Chiyoda-ku (JP); Yasuhiro Kojima, Chiyoda-ku (JP); Hidetoshi Muramatsu, Chiyoda-ku (JP); Hirokuni Shiba, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 302 days.

(21) Appl. No.: 12/887,635

(22) Filed: Sep. 22, 2010

(65) Prior Publication Data

US 2011/0093121 A1 Apr. 21, 2011

(30) Foreign Application Priority Data

Oct. 21, 2009 (JP) ..... 2009-242500

(51) Int. Cl.
*G05B 13/00* (2006.01)

(52) U.S. Cl.
USPC ..... 700/276; 700/296; 700/295; 700/300; 700/291; 700/278

(58) Field of Classification Search
None
See application file for complete search history.

(56) References Cited

U.S. PATENT DOCUMENTS 5,222,370 A * 6/1993 James ..... 62/175
5,572,438 A * 11/1996 Ehlers et al. ..... 700/295
5,684,710 A * 11/1997 Ehlers et al. ..... 700/293
5,696,695 A * 12/1997 Ehlers et al. ..... 700/286
6,539,736 B1 * 4/2003 Isazawa et al. ..... 62/175
6,732,540 B2 * 5/2004 Sugihara et al. ..... 62/177
6,843,066 B2 * 1/2005 Lee et al. ..... 62/175

(Continued)

FOREIGN PATENT DOCUMENTS

EP 1 950 504 A2 7/2008
JP 8-005126 A 1/1996

(Continued)

OTHER PUBLICATIONS

Office Action from Japanese Patent Office issued in corresponding Japanese Patent Application No. 2009-242500 dated Nov. 8, 2011, with an English translation thereof.

(Continued)

*Primary Examiner* — Kavita Padmanabhan
*Assistant Examiner* — Christopher E Everett
(74) *Attorney, Agent, or Firm* — Buchanan Ingersoll & Rooney PC

(57) ABSTRACT

A control device that controls a plurality of air conditioners includes a data memory section for storing performance model data representing the relationship between air conditioning capability and power consumption for each of the plurality of air conditioners. An overall air conditioning load calculating section calculates an overall load that is the sum of air conditioning loads of the plurality of air-conditioning apparatuses. An air conditioning capability allocation calculating section an air conditioning capability for each of the plurality of air conditioners on the basis of the performance model data and the overall load so that the sum of the air conditioning capability of the plurality of air conditioners is the overall load and the sum of the power consumption of the plurality of air conditioners is minimum. A control signal section sends a control signal related to the air conditioning capability to each of the plurality of air conditioners.

12 Claims, 10 Drawing Sheets

(56) References Cited

U.S. PATENT DOCUMENTS

| | | | | |
|---|---|---|---|---|
| 7,010,392 | B2 * | 3/2006 | Bash et al. | 700/276 |
| 7,062,927 | B2 * | 6/2006 | Kwon et al. | 62/126 |
| 7,130,719 | B2 * | 10/2006 | Ehlers et al. | 700/276 |
| 7,343,226 | B2 * | 3/2008 | Ehlers et al. | 700/276 |
| 7,472,558 | B1 * | 1/2009 | Narita | 62/175 |
| 7,871,014 | B2 * | 1/2011 | Park et al. | 236/51 |
| 7,949,615 | B2 * | 5/2011 | Ehlers et al. | 705/412 |
| 8,036,779 | B2 * | 10/2011 | Ito et al. | 700/277 |
| 2002/0082747 | A1 * | 6/2002 | Kramer | 700/276 |
| 2004/0117330 | A1 * | 6/2004 | Ehlers et al. | 705/412 |
| 2005/0192680 | A1 * | 9/2005 | Cascia et al. | 700/29 |
| 2005/0204758 | A1 * | 9/2005 | Kwon et al. | 62/175 |
| 2006/0080980 | A1 * | 4/2006 | Lee et al. | 62/157 |
| 2006/0130496 | A1 * | 6/2006 | Chapman et al. | 62/126 |
| 2006/0191275 | A1 * | 8/2006 | Jung et al. | 62/228.1 |
| 2007/0043478 | A1 * | 2/2007 | Ehlers et al. | 700/276 |
| 2008/0178615 | A1 * | 7/2008 | Yoon et al. | 62/79 |
| 2008/0179410 | A1 * | 7/2008 | Yoon et al. | 236/51 |
| 2009/0259345 | A1 * | 10/2009 | Kato et al. | 700/295 |
| 2010/0010679 | A1 * | 1/2010 | Kassel | 700/278 |
| 2010/0076607 | A1 * | 3/2010 | Ahmed et al. | 700/276 |
| 2010/0125370 | A1 * | 5/2010 | Baba et al. | 700/276 |
| 2010/0292860 | A1 * | 11/2010 | Komiya et al. | 700/295 |
| 2011/0130887 | A1 * | 6/2011 | Ehlers, Sr. | 700/296 |
| 2011/0209487 | A1 * | 9/2011 | Tachiki et al. | 62/129 |

FOREIGN PATENT DOCUMENTS

| | | | |
|---|---|---|---|
| JP | 9-079650 | A | 3/1997 |
| JP | 2005-229758 | A | 8/2005 |
| JP | 2006-207855 | A | 8/2006 |
| JP | 2007-085601 | A | 4/2007 |
| JP | 2007-263546 | A | 10/2007 |
| JP | 2008-057818 | A | 3/2008 |
| JP | 2008-064447 | A | 3/2008 |
| JP | 2009-020640 | A | 1/2009 |
| JP | 2009-216259 | A | 9/2009 |

OTHER PUBLICATIONS

The Extended Search Report dated Feb. 1, 2012, issued in the corresponding European Patent Application No. 10009187.5. (6 pages).

Office Action from Chinese Patent Office dated Aug. 10, 2012, issued in corresponding Chinese Patent Application No. 201010295994.6, with English translation thereof.

* cited by examiner

| Air conditioner No. | Secondary coefficient | Primary coefficient | Constant | Maximum capability | Minimum capability |
|---|---|---|---|---|---|
| 1 | $a_1$ | $b_1$ | $c_1$ | $Q_1^{max}$ | $Q_1^{min}$ |
| 2 | $a_2$ | $b_2$ | $c_2$ | $Q_2^{max}$ | $Q_2^{min}$ |
| 3 | $a_3$ | $b_3$ | $c_3$ | $Q_3^{max}$ | $Q_3^{min}$ |
| 4 | $a_4$ | $b_4$ | $c_4$ | $Q_4^{max}$ | $Q_4^{min}$ |

| Air conditioner No. | Operating status |
|---|---|
| 1 | 1 |
| 2 | 0 |
| 3 | 1 |
| 4 | -1 |

| Air conditioner No. | Air conditioning load |
|---|---|
| 1 | $L_1$ |
| 2 | $L_2$ |
| 3 | $L_3$ |
| 4 | -1 |

FIG. 11

| Air conditioner No. | Operable status |
|---|---|
| 1 | 1 |
| 2 | 1 |
| 3 | 1 |
| 4 | 0 |

FIG. 12

| Combination No. | Air conditioner No. to be assumed to be operated | Air conditioner No. to be assumed to be shut down |
|---|---|---|
| 1 | 1 | 2, 3 |
| 2 | 2 | 1, 3 |
| 3 | 3 | 1, 2 |
| 4 | 1, 2 | 3 |
| 5 | 1, 3 | 2 |
| 6 | 2, 3 | 1 |
| 7 | 1, 2, 3 | – |

FIG. 13

| Air conditioner No. | Secondary coefficient | Primary coefficient | Constant | Maximum capability | Minimum capability | Power consumption associated with thermostat off |
|---|---|---|---|---|---|---|
| 1 | $a_1$ | $b_1$ | $c_1$ | $Q_1^{max}$ | $Q_1^{min}$ | $W_1^{OFF}$ |
| 2 | $a_2$ | $b_2$ | $c_2$ | $Q_2^{max}$ | $Q_2^{min}$ | $W_2^{OFF}$ |
| 3 | $a_3$ | $b_3$ | $c_3$ | $Q_3^{max}$ | $Q_3^{min}$ | $W_3^{OFF}$ |
| 4 | $a_4$ | $b_4$ | $c_4$ | $Q_4^{max}$ | $Q_4^{min}$ | $W_4^{OFF}$ |

FIG. 14

| Air conditioner No. | Secondary coefficient | Primary coefficient | Constant | Maximum capability | Minimum capability |
|---|---|---|---|---|---|
| 1 | $a'_1$ | $b'_1$ | $c'_1$ | $Q_1^{max}$ | $Q_1^{min}$ |
| 2 | $a'_2$ | $b'_2$ | $c'_2$ | $Q_2^{max}$ | $Q_2^{min}$ |
| 3 | $a'_3$ | $b'_3$ | $c'_3$ | $Q_3^{max}$ | $Q_3^{min}$ |
| 4 | $a'_4$ | $b'_4$ | $c'_4$ | $Q_4^{max}$ | $Q_4^{min}$ |

FIG. 17

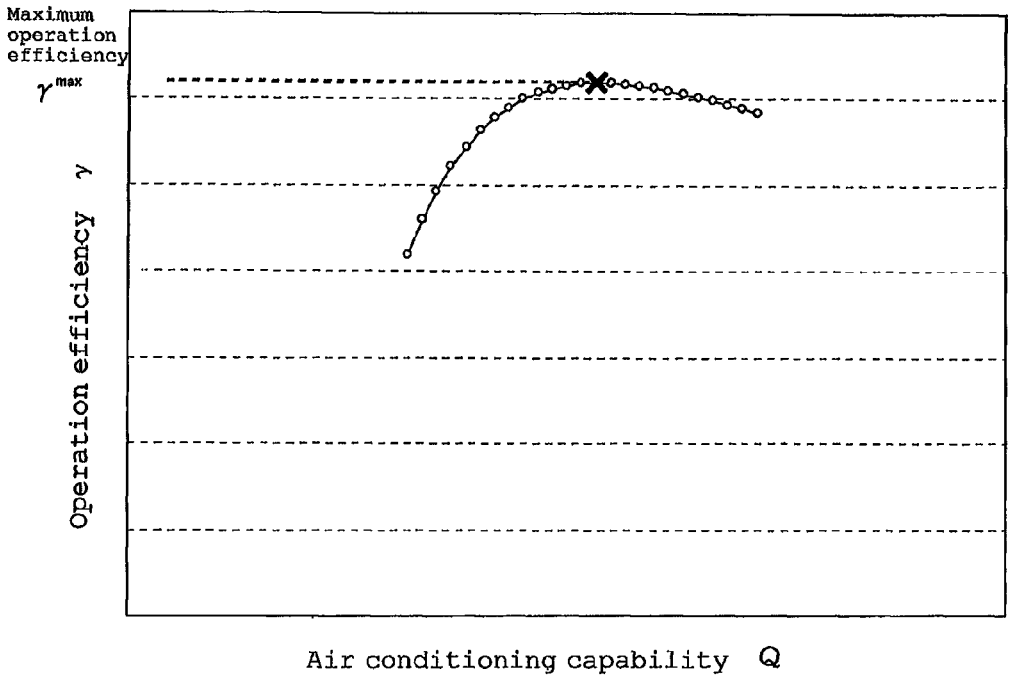

FIG. 18

| Air conditioner No. | Secondary coefficient | Primary coefficient | Constant | Maximum capability | Minimum capability | Maximum operation efficiency |
|---|---|---|---|---|---|---|
| 1 | $a_1$ | $b_1$ | $c_1$ | $Q_1^{max}$ | $Q_1^{min}$ | $\gamma^{max}_{base,1}$ |
| 2 | $a_2$ | $b_2$ | $c_2$ | $Q_2^{max}$ | $Q_2^{min}$ | $\gamma^{max}_{base,2}$ |
| 3 | $a_3$ | $b_3$ | $c_3$ | $Q_3^{max}$ | $Q_3^{min}$ | $\gamma^{max}_{base,3}$ |
| 4 | $a_4$ | $b_4$ | $c_4$ | $Q_4^{max}$ | $Q_4^{min}$ | $\gamma^{max}_{base,4}$ |

FIG. 19

| Combination No. | Air conditioner No. to be assumed to be operated | Air conditioner No. to be assumed to be shut down |
|---|---|---|
| 1 | 2 | 1,3 |
| 2 | 2, 1 | 3 |
| 3 | 2, 1, 3 | – |

FIG. 20

| Air conditioner No. | Operating status |
|---|---|
| 1 | 1 |
| 2 | 1 |
| 3 | 1 |
| 4 | -1 |

FIG. 21

| Air conditioner No. | Operating status |
|---|---|
| 1 | 1 |
| 2 | 1 |
| 3 | 1 |
| 4 | -2 |

FIG. 22

| Air conditioner No. | Operable status |
|---|---|
| 1 | 1 |
| 2 | 1 |
| 3 | 0 |
| 4 | -1 |

FIG. 23

| Air conditioner No. | Operable status |
|---|---|
| 1 | 1 |
| 2 | 1 |
| 3 | -2 |
| 4 | 1 |

AIR-CONDITIONING APPARATUS CONTROL DEVICE AND REFRIGERATING APPARATUS CONTROL DEVICE

TECHNICAL FIELD

The present invention relates to an air-conditioning apparatus control device that controls a plurality of air-conditioning apparatuses and a refrigerating apparatus control device that controls a plurality of refrigerating apparatuses.

BACKGROUND ART

There is disclosed a device that controls the control element of an air-conditioning apparatus or a refrigerating apparatus by determining coordinated operation conditions based on an empirical rule or a planned method (such as mathematical programming and meta-heuristic methods), in order to reduce the power consumption of a system that includes a plurality of air-conditioning apparatuses (hereinafter may be referred to as "air conditioner") or refrigerating apparatuses (hereinafter may be referred to as "refrigerator").

The operation technique for a plurality of refrigerators disclosed in Patent Literature 1, for example, determines an approximation formula that models the relationship between the refrigerating capacity and the power consumption of the plurality of refrigerators, compares operation result data center for correcting the approximation formula on the basis of variation in relative values, calculates the overall power consumption of the plurality of refrigerators on the basis of the corrected approximation formula, and sets the refrigerating capacity for each of the refrigerators to ensure reduced power consumption, thereby controlling the operating status.

For a system in which many air conditioners are combined, the air conditioner operation control device disclosed in Patent Literature 2, for example, determines the optimum air conditioner operating conditions on the basis of a genetic algorithm or a mutually-integrated neuro.

In cases where a plurality of air conditioners are provided in one space (air conditioning zone), the operation control method disclosed in Patent Literature 3, for example, determines an air conditioner to be preferentially operated from the operation efficiency of each of the air conditioners and issues an operation commencement command or an output increase command, thereby providing a central control system using a control computer for saving of energy and enhanced durability, and reliability.

CITATION LIST

Patent Literature

[PTL 1] Japanese Unexamined Patent Application Publication No. 2007-85601 (FIG. 4 on page 3, lines 27-39)

[PTL 2] Japanese Unexamined Patent Application Publication No. Hei-8-5126 (FIG. 1 on page 3, line 49 on the left to line 33 column on the right column)

[PTL 3] Japanese Unexamined Patent Application Publication No. 2008-57818 (FIG. 10 on page 3, line 45 to page 4, line 5)

SUMMARY OF INVENTION

Technical Problem

In cases where a plurality of air conditioners (or refrigerators) are provided for air-conditioning a common space, if such air conditioners perform air conditioning operation separately from each other, some of the air conditioners provide too high air-conditioning capability and the others provide too low air-conditioning capability, resulting in inability to reduce the energy consumption of the entire system. For this reason, there is a need for performing coordinated control of a plurality of air conditioners and thereby saving energy consumption.

The known art, however, has a disadvantage in that a system of a plurality of air conditioners or refrigerators cannot be efficiently controlled for determining proper air conditioning capability or refrigerating capability and thereby reducing the overall system power consumption.

In Patent Literature 1, for example, an overall air-conditioning load is allocated according to the ratio of the capacity of an air conditioner apparatus in operation to determine the air conditioning capability and then the power consumption for the allocated air conditioning capability is evaluated from an approximation model formula showing the relationship between the air conditioning capability and the power consumption.

However, allocation according to the ratio of the capacity may lead to the occurrence of an air conditioning capability allocation which further reduces power consumption, or cannot necessarily determine the air-conditioning capability that results in reduction in power consumption.

Primarily, it is necessary to determine an air conditioning capability capable of reducing power consumption from the relationship between air conditioning capability and power consumption.

Since an allocation of the air conditioning capability to match the overall air conditioning load depends on the number of air conditioners to be operated, the amount of power consumption resulting from the allocation of air conditioning capability has a close relationship with the determination of the number of air conditioners to be operated. It is essential to determine the number of air conditioners to be operated in order to attain a reduction in the overall system power consumption.

The known art, when seen from this viewpoint, leads to a problem that efficient control cannot be performed for determining the foregoing air conditioning capability and the number of air conditioners to be operated on an integral basis.

Also, the known art causes problems such as high calculation loads in calculation and a large amount of data required for calculation, which results in degraded calculation capability due to practical restriction and difficulty in installing in a microcomputer having limited memory.

The present invention has been achieved to solve the problems described above and an object thereof is to provide an air-conditioning apparatus control device that can attain reduction in the total power consumption while maintaining a balance between the overall air conditioning load and the total air-conditioning capability of air conditioners in a space to be subjected to air conditioning.

Another object of the present invention is to provide a refrigerating apparatus control device that can achieve reduction in the total power consumption while maintaining a balance between the overall refrigerating load and the total refrigerating capability of refrigerators in a space to be subjected to refrigeration.

Solution to Problem

An air-conditioning apparatus control device according to the present invention is an air-conditioning apparatus control device that controls a plurality of air-conditioning apparatuses provided for air-conditioning a common space, including a data memory means for storing performance model data representing a relationship between air conditioning capability and power consumption for each of the plurality of air-conditioning apparatuses, an overall air conditioning load calculating means for calculating an overall air conditioning load that is the sum of air conditioning loads of the plurality of air-conditioning apparatuses, an air conditioning capability allocation calculating means for determining an air conditioning capability for each of the plurality of air-conditioning apparatuses on the basis of the performance model data and the overall air conditioning load so that the sum of the air conditioning capability of the plurality of air-conditioning apparatuses is equal to the overall air conditioning load and that the sum of the power consumption of the plurality of air-conditioning apparatuses is minimum, and a control signal sending means for sending a control signal related to the air conditioning capability to each of the plurality of air-conditioning apparatuses.

A refrigerating apparatus control device according to the present invention is a refrigerating apparatus control device that controls a plurality of refrigerating apparatuses provided for refrigerating a common space, including a data memory means for storing performance model data representing a relationship between refrigerating capability and power consumption for each of the plurality of refrigerating apparatuses, an overall refrigerating load calculating means for calculating an overall refrigerating load that is the sum of refrigerating loads of the plurality of refrigerating apparatuses, an refrigerating capability allocation calculating means for determining a refrigerating capability for each of the plurality of refrigerating apparatuses on the basis of the performance model data and the overall refrigerating load so that the sum of the refrigerating capability of the plurality of refrigerating apparatuses is equal to the overall refrigerating load and that the sum of the power consumption of the plurality of refrigerating apparatuses is minimum, and a control signal sending means for sending a control signal related to the refrigerating capability to each of the plurality of refrigerating apparatuses.

Advantageous Effects of Invention

The present invention determines an air conditioning capability for each of the plurality of air-conditioning apparatuses on the basis of the performance model data and the overall air conditioning load so that the sum of the air conditioning capability of the plurality of air-conditioning apparatuses is equal to the overall air conditioning load and that the sum of the power consumption of the plurality of air-conditioning apparatuses is minimum.

Accordingly, the present invention can achieve a reduction in the total power consumption while the balance between the overall air conditioning load and the sum of the air-conditioning apparatus air conditioning capability is maintained.

Also, the present invention determines an refrigerating capability for each of the plurality of refrigerating apparatuses on the basis of the performance model data and the overall refrigerating load so that the sum of the refrigerating capability of the plurality of refrigerating apparatuses is equal to the overall refrigerating load and that the sum of the power consumption of the plurality of refrigerating apparatuses is minimum.

Accordingly, the present invention can achieve a reduction in the total power consumption while the balance between the overall refrigerating load and the sum of the refrigerating apparatus refrigerating capability is maintained.

BRIEF DESCRIPTION OF DRAWINGS

FIG. 11 is a chart showing the data format of operable information data according to Embodiment 2.

FIG. 12 is a chart showing the data format of an operation combination list of an air conditioner according to Embodiment 2.

FIG. 13 is a chart showing the data format of expanded performance model data according to Embodiment 3.

FIG. 14 is a chart showing the data format of performance model data according to Embodiment 4.

FIG. 17 is a typical graph representing the relationship between air conditioning capability and operation efficiency.

FIG. 18 is a chart showing the data format of expanded performance model data according to Embodiment 5.

FIG. 19 is a chart showing the data format of an operation combination list of an air conditioner according to Embodiment 5.

FIG. 20 is a chart showing the data format of operation information data according to Embodiment 6.

FIG. 21 is a chart showing the data format of operation information data according to Embodiment 6.

FIG. 22 is a chart showing the data format of operable information data according to Embodiment 6.

FIG. 23 is a chart showing the data format of operable information data according to Embodiment 6.

DESCRIPTION OF EMBODIMENTS

Embodiment 1

Figure 1:
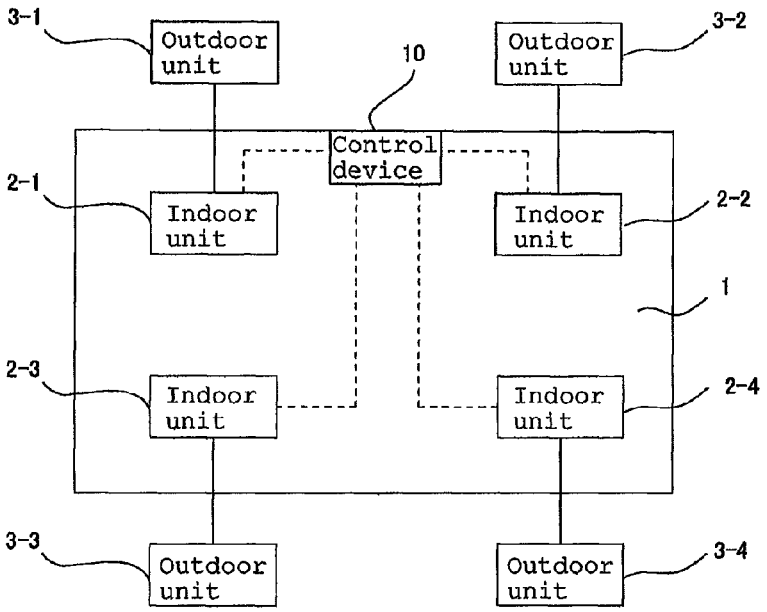
FIG. 1 is a diagram illustrating an overall configuration of an air-conditioning apparatus according to Embodiment 1 of the present invention.

FIG. 1 is a diagram illustrating an overall configuration of an air-conditioning apparatus according to Embodiment 1.

In FIG. 1, an air-conditioning apparatus control device (hereinafter referred to as "control device 10") according to this Embodiment is a device that controls a plurality of air-conditioning apparatuses provided for air-conditioning a common space (hereinafter referred to as "space subjected to air conditioning 1").

Each of the plurality of air-conditioning apparatuses (hereinafter may be referred to as "air conditioner") has an indoor unit 2 and an outdoor unit 3. The indoor unit 2 is disposed in the space subjected to air conditioning 1. The outdoor unit 3 is disposed outside the space subjected to air conditioning 1. The indoor unit 2 and the outdoor unit 3 are connected to each other through a refrigerant tube.

Such an air conditioner provides air-conditioning of the space subjected to air conditioning 1 through heat absorption and heat dissipation of a refrigerant by causing the pressure of the refrigerant flowing in the refrigerant tube to change under the control of the control device 10.

Although the overall configuration of an air conditioner system consisting of four air conditioners is depicted in this Embodiment, the number N of air conditioners may be equal to or greater than two.

In the description that follows, the four air conditioners are distinguished from each other by air conditioner Nos. 1 through 4.

The control device 10 is connected to each of the indoor units 2 through a communication line. The control device 10 receives as input information measurement data and operational status information sensed by the sensors provided on the indoor unit 2 and the outdoor unit 3.

Also, the control device 10 sends as control signals user-specified setting information related to air conditioners and the results obtained by calculation of the control device 10 and the like to the indoor unit 2 and the outdoor unit 3.

The control device 10 may be constructed of an ordinary remote control device having a control function to which the present invention does not apply or may be provided separately from an ordinary remote control device.

Furthermore, the control device 10 may consist of a calculator. Also, communications between the control device 10 and each of the indoor units 2 may be made via wireless communications.

Figure 2:
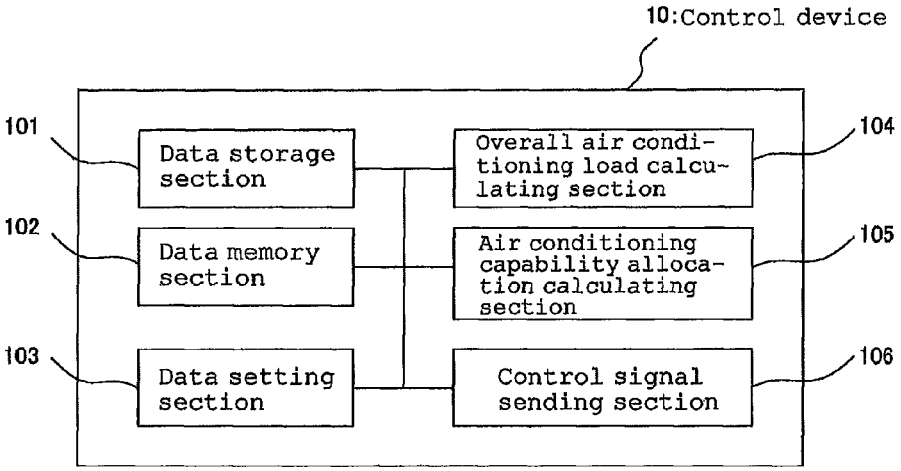
FIG. 2 is a functional block diagram of a control device according to Embodiment 1.

FIG. 2 is a functional block diagram of a control device according to Embodiment 1.

As shown in FIG. 2, the control device 10 includes a data storage section 101, a data memory section 102, a data setting section 103, an overall air conditioning load calculating section 104, an air conditioning capability allocation calculating section 105, and a control signal sending section 106.

"Data storage section 101" corresponds to "data storage means" according to the present invention.

"Data memory section 102" corresponds to "data memory means" according to the present invention.

"Overall air conditioning load calculating section 104" corresponds to "overall air conditioning load calculating means" according to the present invention.

"Air conditioning capability allocation calculating section 105" corresponds to "air conditioning capability allocation calculation means" according to the present invention.

"Control signal sending section 106" corresponds to "control signal sending means" according to the present invention.

The data storage section 101 stores setting data inputted by a user, air conditioning load data and operation information data inputted through a communication line, partly-calculated intermediate data of the calculating section, and the output data used for control, obtained following calculation. The content of each piece of data is described later.

The data memory section 102 stores the fundamental definition data and the like used by the overall air conditioning load calculating section 104 and the air conditioning capability allocation calculating section 105, which is referenced for calculation, when needed.

The data stored in the data memory section 102 includes, but not limited to, functional coefficient data representing performance model defining the relationship between air conditioning capability and power consumption, and maximum air conditioning capability/minimum air conditioning capability (hereinafter referred to as "performance model data"), which are stored for each air conditioner. The contents of these pieces of data are described later.

The data setting section 103 sets various types of data necessary for calculation or executes an initialization process.

The overall air conditioning load calculating section 104 references the capability value (air conditioning load) of each air conditioner at next control timing from the data storage section 101, and obtains overall air conditioning load by calculating the total sum of air conditioning loads of all air conditioners at such next control timing. Then, it writes the overall air conditioning load data obtained following such execution into the data storage section 101.

The air conditioning capability allocation calculating section 105 references overall air conditioning load data from the data storage section 101. Also, it references performance model data from the data memory section 102. It executes processing for calculating an allocation to each outdoor unit of air conditioning capability that ensures reduction in power consumption while maintaining a balance with the overall air conditioning capability, taking into account the performance model. Then, it writes an air conditioning capability value obtained by such execution into the data storage section 101. Details are described later.

The control signal sending section 106 executes processing for reading such a calculated air conditioning capability for each air conditioner from the data storage section 101 and sending a control signal specifying the air conditioning capability to each air conditioner through a communication line.

The overall air conditioning load calculating section 104, the air conditioning capability allocation calculating section 105, or the control signal sending section 106 may be implemented using hardware such as a circuit device which implements these functions, or using software executed on an arithmetic device (computer) such as a microcomputer or a CPU.

The data storage section 101, the data memory section 102, or the data setting section 103 may be constructed of a storage device such as a flash memory.

Figure 3:
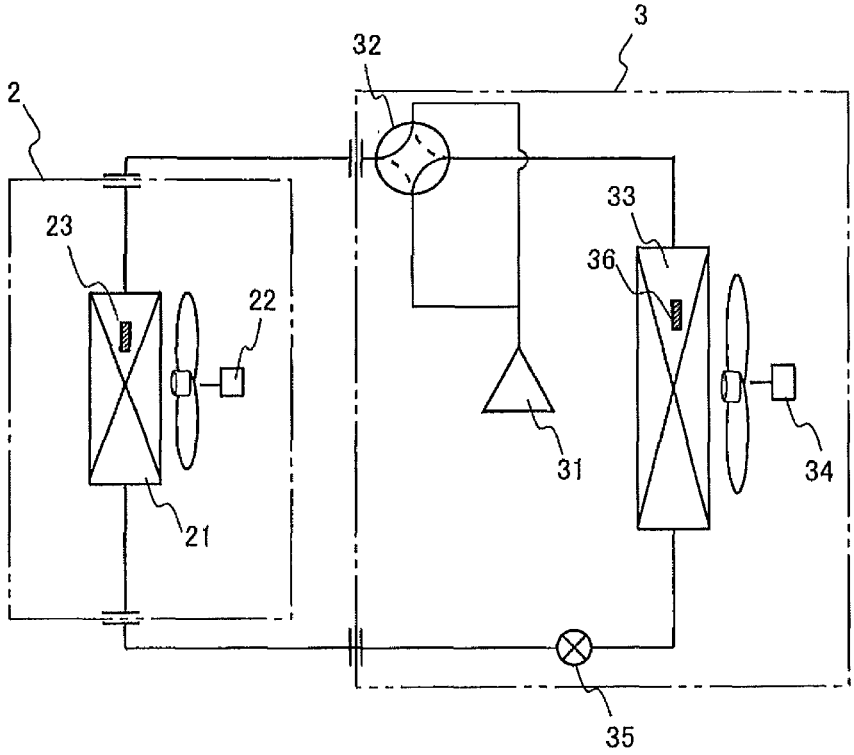
FIG. 3 is a diagram schematically showing a refrigerant circuit of an air-conditioning apparatus according to Embodiment 1.

FIG. 3 is a diagram schematically showing a refrigerant circuit of an air-conditioning apparatus according to Embodiment 1.

As shown in FIG. 3, the indoor unit 2 and the outdoor unit 3 of each air conditioner are connected to each other through liquid connection tubes and gas connection tubes.

Although one air conditioner having one indoor unit 2 and one outdoor unit 3 is described in this Embodiment, the present invention is not limited to this, and may have a plurality of indoor and outdoor units.

The indoor unit 2 has an indoor heat exchanger 21, an indoor blower fan 22, and a temperature sensor 23.

The outdoor unit 3 has a compressor 31, a four-way valve 32, an outdoor heat exchanger 33, an outdoor blower fan 34, and a throttle device 35. Such a compressor 31, an outdoor heat exchanger 33, a throttle device 35, and an indoor heat exchanger 21 are annularly connected to form a refrigerant circuit.

"Temperature sensor 23" corresponds to "first temperature sensing means" according to the present invention.

Also, "Temperature sensor 36" corresponds to "second temperature sensing means" according to the present invention.

The indoor heat exchanger 21 consists of, for example, a cross-fin type fin-and-tube heat exchanger constructed of a heat-transfer tube and many fins. The indoor heat exchanger 21 functions as a refrigerant evaporator during cooling operation for cooling the air in a room. Also, the indoor heat exchanger 21 functions as a refrigerant condenser during heating operation for heating the air in a room.

The indoor blower fan 22 consists of a fan that is attached to the indoor heat exchanger 21 and can vary an air flow to the indoor heat exchanger 21. The indoor blower fan 22 introduces room air into the indoor unit 2 and sends the air subjected to heat exchange with the refrigerant by the indoor heat exchanger 21 to the space subjected to air conditioning 1 as a supply air.

The temperature sensor 23 consists of, for example, a thermistor. The temperature sensor 23 senses the temperature of a gas-liquid two-phase refrigerant flow in the indoor heat exchanger 21. In other words, it senses the condensation temperature associated with heating operation and the evaporation temperature associated with cooling operation.

The compressor 31 includes a positive-displacement compressor that can vary the operation capacity and is driven by, for example, an inverter-controlled motor (not illustrated). The compressor 31 is controlled by the control device 10.

Although the case where only one compressor 31 is provided is described in this Embodiment, the present invention is not limited to this, and two or more compressors 31 may be connected in parallel, depending on the number of the indoor units 2 connected.

The four-way valve 32 is a valve for switching the direction of a refrigerant flow. The four-way valve 32 switches a refrigerant passage in such a manner that during cooling operation the outlet side of the compressor 31 is connected to the outdoor heat exchanger 33 and the inlet side of the compressor 31 is connected to the indoor heat exchanger 21. Also, the four-way valve 32 switches the refrigerant passage in such a manner that during heating operation the outlet side of the compressor 31 is connected to the indoor heat exchanger 21 and the inlet side of the compressor 31 is connected to the outdoor heat exchanger 33.

The outdoor heat exchanger 33 consists of, for example, a cross-fin type fin-and-tube heat exchanger constructed of a heat-transfer tube and many fins. The outdoor heat exchanger 33 has a gas side thereof connected to the four-way valve 32 and a liquid side thereof connected to the throttle device 35. The outdoor heat exchanger 33 functions as a refrigerant condenser during cooling operation, and functions as a refrigerant evaporator during heating operation.

The outdoor blower fan 34 consists of a fan that is attached to the outdoor heat exchanger 33 and can vary an air flow to the outdoor heat exchanger 33. The outdoor blower fan 34 introduces outside air into the outdoor unit 3 and discharges the air subjected to heat exchange with the refrigerant by the outdoor heat exchanger 33 to the outside.

The throttle device 35 is disposed at the liquid side tube of the outdoor unit 3. The throttle device 35 has a variable opening, regulating a refrigerant flow rate in the refrigerant circuit.

The temperature sensor 36 consists of, for example, a thermistor. The temperature sensor 36 senses the temperature of a gas-liquid two-phase refrigerant flow in the outdoor heat exchanger 33. In other words, it senses the condensation temperature associated with cooling operation and the evaporation temperature associated with heating operation.

Described above is the structure of the control device 10 of an air-conditioning apparatus according to this Embodiment. Described below are various pieces of data stored in the data storage section 101 and the data memory section 102.

[Performance Model Data]

Figures 4, 5, 6, 7:
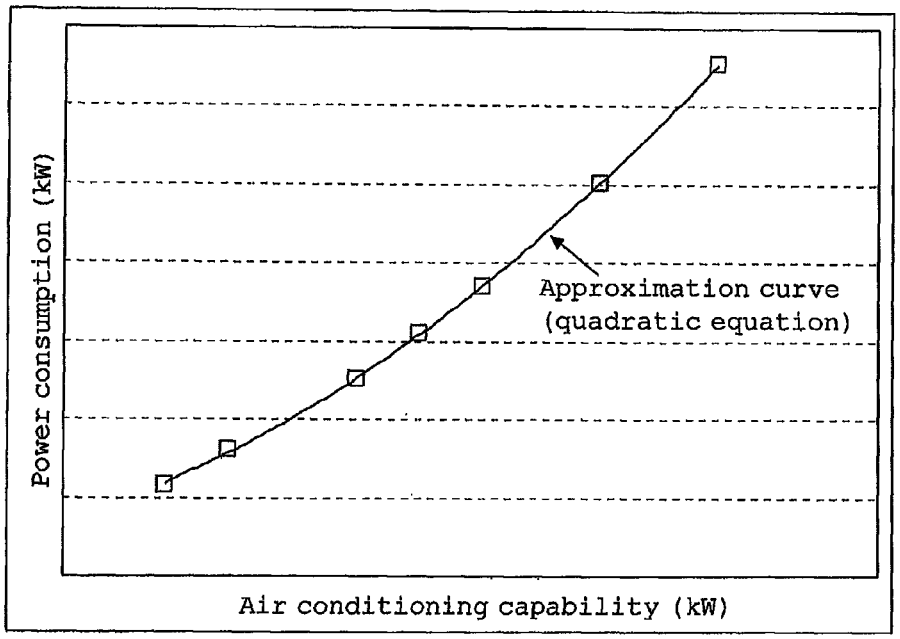
FIG. 4 is a typical diagram showing the relationship between air conditioning capability and power consumption.
FIG. 5 is a chart showing the data format of performance model data according to Embodiment 1.
FIG. 6 is a chart showing the data format of operation information data according to Embodiment 1.
FIG. 7 is a chart showing the data format of air conditioning load data according to Embodiment 1.

FIG. 4 is a typical diagram showing the relationship between air conditioning capability and power consumption.

FIG. 5 is a chart showing the data format of performance model data according to Embodiment 1.

Air conditioner power consumption mainly consists of compressor power consumption, electronic substrate input power consumption, and indoor/outdoor fan input power consumption and the like. The relationship between air conditioning capability and power consumption is as shown in FIG. 4 and can be sufficiently approximated by a quadratic equation such as Equation 1 below.

[Equation 1]

$$W_k = a_k Q^2_k + b_k Q_k + C_k \quad \text{(Equation 1)}$$

Where $W_k$(kW) represents the power consumption of an air conditioner k (k=1, 2, 3). $Q_k$(kW) represents the air conditioning capability of an air conditioner k. $a_k$, $b_k$, and $C_k$ represent coefficient data.

The coefficient data for each air conditioner in Equation 1 is defined as performance model data, together with the minimum capability value $Q^{min}$ (kW) and the maximum capability value $Q^{max}$ (kW) for an air conditioner.

The performance model data is stored in the data memory section 102 in the data format shown in, for example, FIG. 5 for each air conditioner.

[Operation Information Data]

FIG. 6 is a chart showing the data format of operation information data according to Embodiment 1.

The operation information data for each air conditioner represents operational status at next control timing to be set on the basis of the current operational status, outside control information (main power off by a user or the like) at the next control timing, and control determination by the air conditioner (forced shutdown period for protecting the air conditioner following an air conditioner thermostat off event, or the like).

For example, the operation information data is defined as "1" for operation subjected to coordinated control to be described later, "0" for shutdown of an air conditioner by the coordinated control, "−1" for air conditioner power off, and "−2" for operation not subjected to coordinated control, and is stored in the data storage section 101 in the data format shown in FIG. 6.

The operation information data is handled in the following manner for the purpose of, for example, the coordinated control.

When the operation information data for an air conditioner is "1", such an air conditioner is in the status of coordinated operation (hereinafter referred to as "balanced operation") at the next control timing, subsequently allowing a control function to change the status to thermostat on/off, if needed.

When the operation information data for an air conditioner is "0", such an air conditioner is in the status of shutdown operation (referred to as "balanced shutdown") under the coordinated control at the next control timing, subsequently allowing the control function to change the status to thermostat on/off, if needed.

In the balanced shutdown status, only the compressor 31 may be changed to the status of temporary shutdown.

The two statuses above are statuses subjected to coordinated control.

When the operation information data for an air conditioner is "−1", such an air conditioner is in the power off status. Power off means that the main power switch is in the open status set by the user, and, unless the main switch is turned by the user to the closed status, return to the thermostat on/off status or to operation not subjected to coordinated control is not accomplished.

When the operation information data for an air conditioner is "−2", such an air conditioner is in the main power switch close status and the thermostat on/off status. However, in response to a user setting or the determination made by the control function, the air conditioner leaves the group of air conditioners subjected to coordinated control, going into the status of the operation not subjected to coordinated control.

[Air Conditioning Load Data]

The air conditioning load data for each air conditioner determines the air conditioning capability to be outputted at the next control timing on the basis of measurement information obtained by sensors provided on each air conditioner.

However, the air conditioning load data cannot be obtained from air conditioners in the power off status and those in the status of operation not subjected to coordinated control.

In this Embodiment, an appropriate air conditioning capability is handled as the air conditioning load (kW) for each air conditioner at the next control timing. For example, rotational frequency (Hz) of the compressor 31 is determined on the basis of the difference ($\Delta T_j$) between air conditioner preset temperature and room temperature, and air conditioning capability (kW) is determined according to such rotational frequency, which is regarded as air conditioning load (kW) for the air conditioner.

The air conditioning load data is sent to the control device 10 through a communication line and stored in the data storage section 101 in the data format shown in FIG. 7.

FIG. 7 is a chart showing the data format of air conditioning load data according to Embodiment 1.

In FIG. 7, the air conditioning load data refers to those obtained under the conditions of operation information data shown in, for example, FIG. 6, representing air conditioning load data (≥0) for air conditioners other than air conditioner No. 4 in the status of power off.

For example, in this Embodiment air conditioners in the status of power off are represented as air conditioning load of "−1". Also, air conditioners in the status of operation not subjected to coordinated control are represented as air conditioning load of "−2".

Coordinated control processing by a plurality of air conditioners according to Embodiment 1 is described below.

Using the relationship between air conditioning capability and power consumption given by the quadratic equation in Equation 1 above, allocation of air conditioning capability leading to reduction in power consumption to air conditioners (Nos. 1 through 4) in operation at the next control timing is conducted in the following manner.

For an overall air conditioning load L, minimization of the total sum of power consumption $W_k$ (k=1, 2, 3 . . . ) is considered, while the balance between the overall air conditioning load L and the sum of air conditioning capability $Q_k$ (k=1, 2, 3 . . . ) in operation is maintained.

$Q^{min}$ and $Q^{max}$ refer to air conditioner minimum capability and maximum capability, respectively.

[Equation 2]

Purpose: (Equation 2)

$$\sum_{k=1}^{4} W_k = (a_1 \cdot Q_1^2 + b_1 \cdot Q_1 + c_1) + (a_2 \cdot Q_2^2 + b_2 \cdot Q_2 + c_2) + (a_3 \cdot Q_3^2 + b_3 \cdot Q_3 + c_3) + (a_4 \cdot Q_4^2 + b_4 \cdot Q_4 + c_4) \rightarrow \text{Minimization}$$

Limiting Conditions $$Q_k^{min} \le Q_k \le Q_k^{max} \quad (k = 1, 2, 3, 4)$$

$$Q_1 + Q_2 + Q_3 + Q_4 = L$$

In other words, the sum of power consumption of all the air conditioners is a multivariable function, where variables are air conditioning capability Q for each air conditioner. Then, the air conditioning capability Q for each air conditioner is determined which causes the above multivariable function to give an extreme value, under the limiting condition that the sum of the air conditioning capability Q for all the air conditioners becomes equal to the overall air conditioning load L.

The solution of Equation 2 above can be analytically found.

Solution using the Lagrange's method of undetermined multipliers is described below. Solution is not limited to this, and other methods may be used as long as they can determine the solution of Equation 2.

Intermediate variable μ whose coefficient is a limiting condition that the sum of the air conditioning capability Q for all the air conditioners becomes equal to the overall air conditioning load L is added to Equation 2 above to give the second multivariable function F like Equation 3.

[Equation 3]

$$F=(a_1Q_1^2+b_1Q_1+c_1)+(a_2Q_2^2+b_2Q_2+c_2)+(a_3Q_3^2+b_3Q_3+c_3)+(a_4Q_4^2+b_4Q_4+c_4)+\mu(L-Q_1-Q_2-Q_3-Q_4) \quad \text{(Equation 3)}$$

Then, the following Equation 4 is obtained from the extreme value condition of Equation 3 above.

[Equation 4]

$$\left.\begin{aligned} \frac{\partial F}{\partial Q_1} &= (2a_1Q_1 + b_1) - \mu = 0 \\ \frac{\partial F}{\partial Q_2} &= (2a_2Q_2 + b_2) - \mu = 0 \\ \frac{\partial F}{\partial Q_3} &= (2a_3Q_3 + b_3) - \mu = 0 \\ \frac{\partial F}{\partial Q_4} &= (2a_4Q_4 + b_4) - \mu = 0 \\ \frac{\partial F}{\partial \mu} &= (L - Q_1 - Q_2 - Q_3 - Q_4) = 0 \end{aligned}\right\} \quad \text{(Equation 4)}$$

After Equation 4 above is arranged, the following Equation 5 gives intermediate variable μ that meets a condition under which the variables of the second multivariable function F give extreme values.

[Equation 5]

$$\mu = \frac{L + \sum_{k=1}^{4} \frac{b_k}{2a_k}}{\sum_{k=1}^{4} \frac{1}{2a_k}} \quad \text{(Equation 5)}$$

In other words, the air conditioning capability Q for each air conditioner is given by the following algebraic equation using the intermediate variable μ, the Lagrange multiplier of Equation 2 that represents the maintenance of the balance between the overall air conditioning load L and the sum of the air conditioning capability $Q_k$.

[Equation 6]

$$Q_k = \frac{\mu - b_k}{2a_k} \quad (k = 1, 2, 3, 4) \quad \text{(Equation 6)}$$

As described above, the air conditioning capability Q for each of the air conditioners is calculated on the basis of the intermediate variable μ and the performance model data, thereby allowing a plurality of air conditioners subjected to coordinated control to determine air conditioning capability to meet the overall air conditioning load at minimum power consumption.

The operation of coordinated control processing according to Embodiment 1 is specifically described below.

Figure 8:
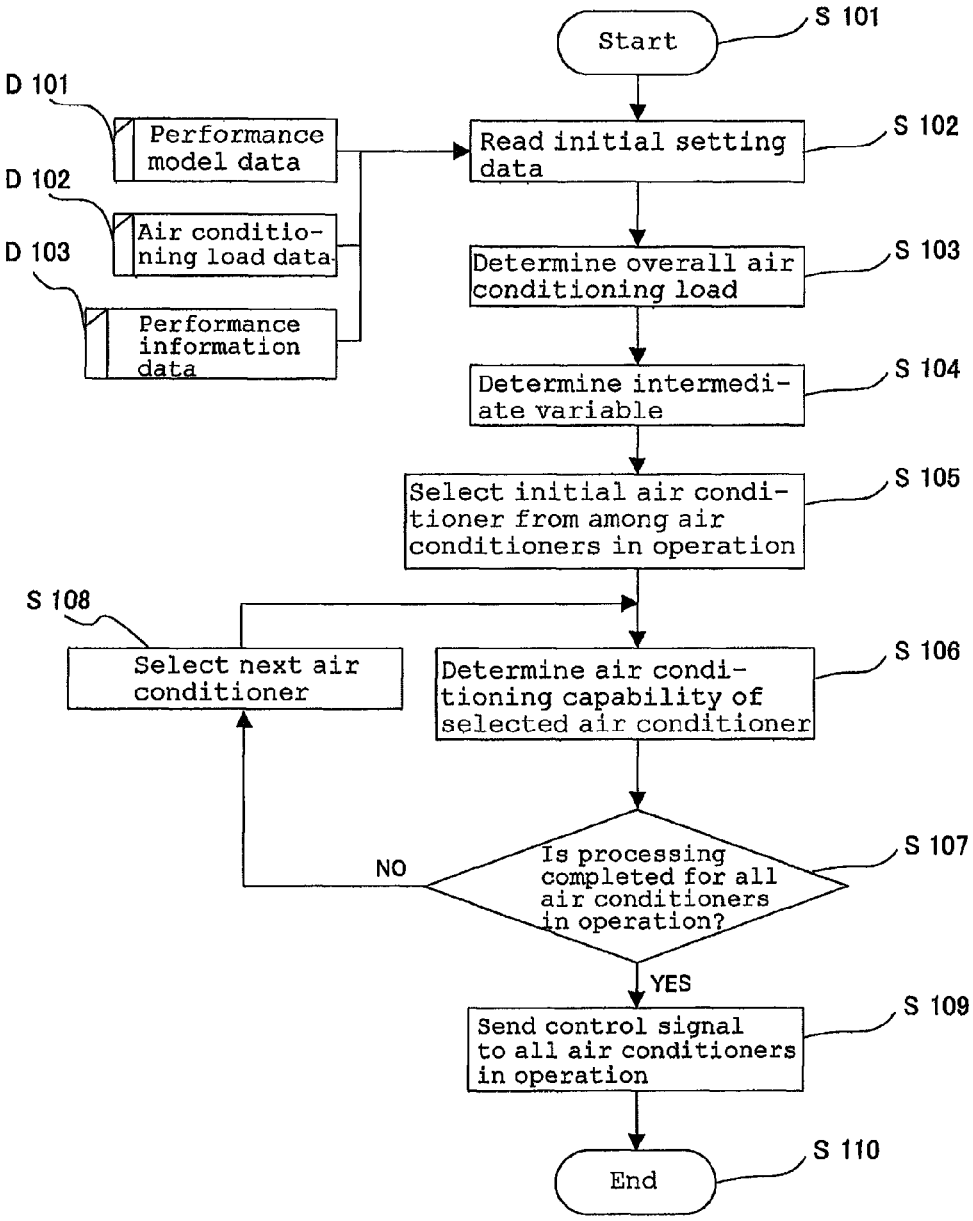
FIG. 8 is a flowchart illustrating operation of coordinated control processing according to Embodiment 1.

FIG. 8 is a flowchart illustrating operation of coordinated control processing according to Embodiment 1.

Description is provided in accordance with a flowchart shown in FIG. 8.

(S101)

In response to start processing step S101, the control device 10 starts a series of computational processing steps in accordance with the flow.

(S102)

In initial data read processing step S102, the data setting section 103 references performance model data D101 pre-stored in the data memory section 102.

Also, the data setting section 103 references air conditioning load data D102 at next control timing, which is stored in the data storage section 101 and measured by each of the air conditioners that is subjected to coordinate control and in the measurable status (status of balanced operation or balanced shutdown).

Furthermore, at the next control timing, the data setting section 103 references the operation information data D103 of an air conditioner in the status of balanced operation or balanced shutdown.

Consequently, the data setting section 103 sets thus referenced performance model data D101, the air conditioning load data D102, and the operation information data D103 as initial data, executing calculation initialization.

Specifically, on the basis of the operation information data D103, the data setting section 103 sets the number of air conditioners subjected to coordinated control to a variable in memory and sets performance model data for the number of such air conditioners to a variable in memory for each air conditioner number.

At this time, a variable for overall air conditioning load L, an intermediate variable μ, and a variable for air conditioning capability $Q_k$ (k=1, 2, 3, 4) of each air conditioner are initialized to "0".

(S103)

Then, the overall air conditioning load calculating section 104 determines the overall air conditioning load L from the air conditioning load data D102.

Specifically, the overall air conditioning load L is determined by calculation as follow.

First, on the basis of the operation information data D103, air conditioners (air conditioners in the status of balanced operation or balanced shutdown) subjected to coordinated control is determined. Second, from the air conditioning load data D102, air conditioning load for the air conditioners subjected to coordinated control is obtained and summed to determine the overall air conditioning load L.

Assuming that operation information data D103 is as shown in, for example, FIG. 6 and air conditioning load data D102 is $L_1$, $L_2$, $L_3$, and −1, as shown in, for example, FIG. 7, the overall air conditioning load L can be determined as $L=L_1+L_2+L_3$ from the air conditioners Nos. 1 through 3 subjected to coordinated control whose air conditioning load is measurable.

(S104)

Then, the air conditioning capability allocation calculating section 105 determines an intermediate variable μ using Equation 5 from the performance model data D101, the air conditioning load data D102, and the operation information data Q103.

Consequently, the result is stored as a variable in the data storage section 101.

(S105)

The air conditioning capability allocation calculating section 105 selects one initial air conditioner (for example, that having the smallest air conditioner number) from among the air conditioners in operation.

For the air conditioner thus selected in step S105 above, the air conditioning capability allocation calculating section 105 determines air conditioning capability Qk using Equation 6 from the intermediate variable μ and the performance model data D101 stored in the data storage section 101.

Consequently, the result is stored as a variable in the data storage section 101.

(S107)

In air conditioner selection completion determination processing step S107, the air conditioning capability allocation calculating section 105 determines whether processing has been completed for all the air conditioners in operation.

(S108)

If processing has not been completed, the flow proceeds to unselected air conditioner selection processing step S108, where the air conditioning capability allocation calculating section 105 selects the next air conditioner from among unselected air conditioners and returns to step S106 where processing is repeated.

If air conditioner selection and the calculation of air conditioning capability have been completed, the flow proceeds to control signal sending processing step S109.

(S109)

In control signal sending processing step S109, the control signal sending section 106 reads as output data air conditioning capability values obtained from a series of calculation steps for each air conditioner from the data storage section 101.

Then, it sends control signals for achieving such air conditioning capability values to each air conditioner through communication line in synchronization with the next control timing.

(S110)

In end processing step s110, a series of calculation processing steps are completed.

The coordinated control described above allows air conditioning capability to meet required overall air conditioning load L to be allocated to each of the air conditioners subjected to coordinated control so as to reduce power consumption. This enables air conditioner control through determination of operational conditions that reduce power consumption as the entire air conditioner system.

As described above, on the basis of the performance model data and the overall air conditioning load L this Embodiment determines air conditioning capability Q for each of a plurality of air conditioners so that the sum of air conditioning capability Q of air conditioners is the overall air conditioning load L and the sum of power consumption W of air conditioners becomes minimum.

This allows the total sum of power consumption $W_k$ to be reduced while the balance between the overall air conditioning load L in the space subjected to air conditioning 1 and the sum of air conditioning capability $Q_k$ of air conditioners in operation is maintained.

Also, on the basis of the performance model data and the overall air conditioning load L, this Embodiment calculates an intermediate variable μ using Equation 5, and then determines air conditioning capability $Q_k$ for each air conditioner using Equation 6 on the basis of such an intermediate variable μ and the performance model data.

This causes the sum of air conditioning capability of air conditioners to become the overall air conditioning load, thereby allowing the air conditioning capability for minimizing the total sum of power consumption to be calculated from the performance model data and the overall air conditioning load L.

Although coordinated control processing by a plurality of air conditioners is described using a flowchart shown in FIG. 8 in Embodiment 1, such a flowchart may be implemented by a program that substantially performs such coordinated control processing. Although, such a program is stored in a remote control microcomputer serving as the control device 10, it is conceivable that such a program is stored in, for example, a hard disk serving as a recording medium if the control device 10 consists of a computer, instead of a remote control device.

Also, a computer readable medium recording such a program may include a CO-ROM or MO or the like, in addition to a hard disk.

Furthermore, the program itself may be obtained via an electrical communication line without via a recording medium.

Embodiment 2

Embodiment 2 is characterized in that, in addition to the features of the control device 10 according to Embodiment 1, a feature for selecting an air conditioner to be operated is provided which allows for air conditioner operating status (balanced operation, balanced shutdown, power off, or operation not subjected to coordinated control) in order to achieve the reduction in the entire air conditioner system power consumption.

The overall configuration of an air conditioning system required for a control device 10 according to Embodiment 2 is the same as that shown in FIG. 1.

Figure 9:
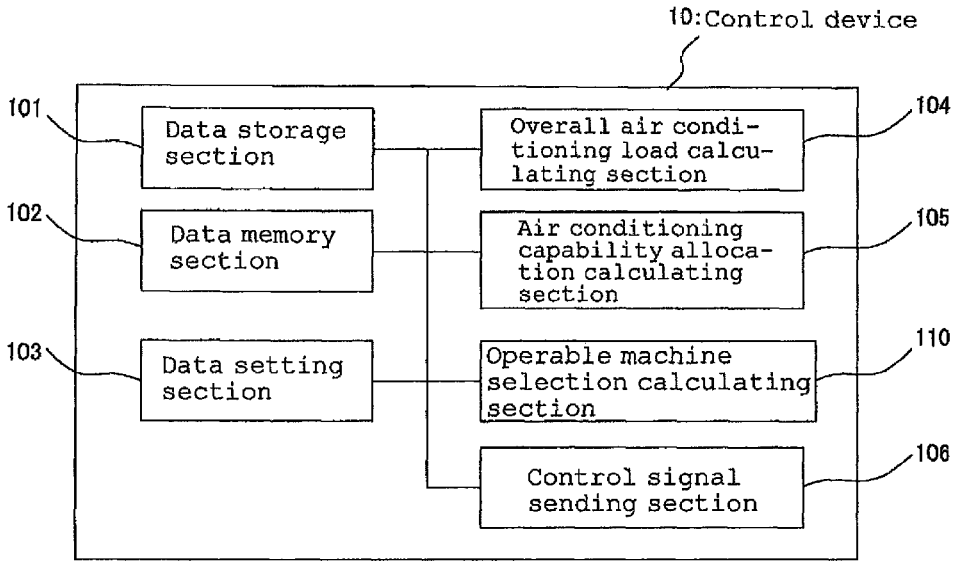
FIG. 9 is a functional block diagram of a control device according to Embodiment 2.

FIG. 9 is a functional block diagram of a control device according to Embodiment 2.

As shown in FIG. 9, the control device 10 according to this Embodiment has an operable machine selection calculating section 110 in addition to the configuration according to Embodiment 1.

A data storage section 101, a data memory section 102, a data setting section 103, an overall air conditioning load calculating section 104, an air conditioning capability allocation calculating section 105, and a control signal sending section 106 according to Embodiment 2 are the same as those according to Embodiment 1.

"Operable machine selection calculating section 110" corresponds to "operable air-conditioning apparatus selection means".

The operable machine selection calculating section 110 selects a combination of air conditioners to be operated and to be shut down from among a plurality of air conditioners.

Specifically, referencing data required for calculation from the data storage section 101 and the data memory section 102, the operable machine selection calculating section 110 performs processing for selecting air conditioners to be operated and to be shut down from among air conditioners (defined as a candidate air conditioner) to be operable at the next control timing.

The thus obtained selection of the air conditioners to be operated and to be shut down is written into the data storage section 101.

Figure 10:
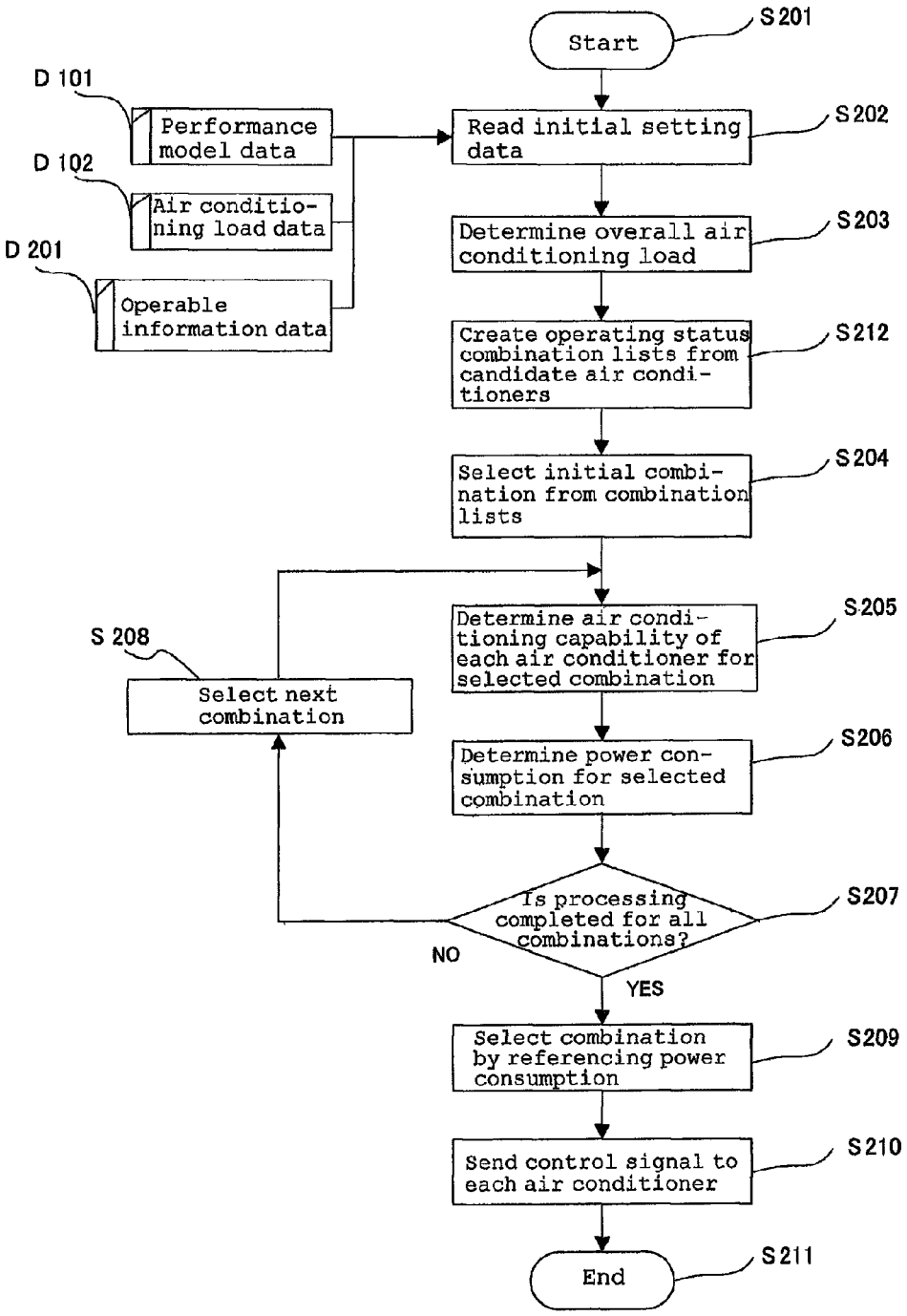
FIG. 10 is a flowchart illustrating operation of coordinated control processing according to Embodiment 2.

FIG. 10 is a flowchart illustrating operation of coordinated control processing according to Embodiment 2.

Description is provided below in accordance with such a flowchart.

(S201)

In response to start processing step S201, the control device 10 starts a series of computational processing steps in accordance with the flow.

(S202)

In initial data read processing step S202, the data setting section 103 references performance model data D101 prestored in the data memory section 102.

Also, the data setting section 103 references air conditioning load data D102 at next control timing, which is stored in the data storage section 101 and measured by each of the air conditioners that is subjected to coordinate control and in the measurable status (status of balanced operation or balanced shutdown).

Furthermore, the data setting section 103 references operable information data D201 of a candidate air conditioner at the next control timing. Such operable information data D201 is described later.

Consequently, the data setting section 103 sets thus referenced performance model data D101, the air conditioning load data D102, and the operable information data D201 as initial data, executing calculation initialization.

Specifically, on the basis of the operable information data D201, the data setting section 103 sets the number of candidate air conditioners subjected to coordinated control to a variable in memory and sets performance model data for the number of such air conditioners to a variable in memory for each air conditioner number.

At this time, a variable for overall air conditioning load L, a variable storing combination data to be created from the candidate air conditioners, an intermediate variable μ for each combination number, a variable for air conditioning capability $Q_k$ of each air conditioner, a variable for power consumption, and a variable for finally selected combination number, are initialized to "0".

Operable information data D201 for a candidate air conditioner is described below.

Such operable information data D201 represents an air conditioner that is operable at the next control timing.

FIG. 11 is a chart showing the data format of operable information data according to Embodiment 2.

For example, the operable information data is defined as "1" if an appropriate air conditioner is operable (such an air conditioner is capable of balanced operation or balanced shutdown at the next control timing and is handled as a candidate air conditioner).

Also, it is defined as "0" if an appropriate air conditioner is inoperable (such an air conditioner is inoperable at the next control timing).

Furthermore it is defined as "−1" if an air conditioner is powered off and as "−2" if not subjected to coordinated operation.

Consequently, the operable information data is stored in the data storage section 101 in the data format shown in FIG. 11.

In this case, air conditioners Nos. 1, 2, and 3 are a candidate air conditioner. The air conditioner No. 4 is an inoperable air conditioner.

(S203)

Then, the overall air conditioning load calculating section 104 determines the overall air conditioning load L, the sum of air conditioning loads of all candidate air conditioners, from the air conditioning load data D102.

The processing is the same as that in step S103 described in Embodiment 1.

(S212)

The operable machine selection calculating section 110 selects a combination of operable air conditioners (which are assumed to be operated at the next control timing) and inoperable air conditioners (which are assumed to be shut down at the next control timing) from among the candidate air conditioners. All the combinations that can be created using the candidate air conditioners are generated as a list, which is stored in the data storage section 101 in the data format shown in FIG. 12.

FIG. 12 is a chart showing the data format of an operation combination list of an air conditioner according to Embodiment 2.

For example, the number of combinations to be created using the candidate air conditioners Nos. 1, 2, and 3 given in FIG. 11 is seven in total, as shown in FIG. 12.

For example, combination No. 1 in FIG. 12 represents that only the air conditioner No. 1 of the candidate air conditioners Nos. 1 through 3 is assumed to be operated at the next control timing and the other air conditioners Nos. 2 and 3 are assumed to be shutdown.

Also, combination No. 7 represents that all of the candidate air conditioners are assumed to be operated.

(S204)

The operable machine selection calculating section 110 selects one initial combination (for example, that having the smallest combination number) from among the combinations created in step S212 above.

(S205)

Then, for the combination thus selected in step S204 above, the air conditioning capability allocation calculating section 105 determines air conditioning capability $Q_k$ for each of the air conditioners assumed to be operated, so that the sum of air conditioning capability Q of the air conditioners assumed to be operated is the overall air conditioning load L of the candidate air conditioners and the sum of power consumption W of air conditioners assumed to be operated becomes minimum.

Consequently, thus obtained result is stored to a variable for the relevant combination No. in the data storage section 101. Processing for determining air conditioning capability $Q_k$ is the same as step S106 described in Embodiment 1.

(S206)

Then, the operable machine selection calculating section 110 calculates the total power consumption $W_{all}$ for a currently selected combination.

Specifically, the operable machine selection calculating section 110 references performance model data D101 from the data memory section 102 and references a variable, to which the calculation result of processing step S205 is stored, from the data storage section 101. Then, it determines the total power consumption $W_{all}$ from the power consumption $W_k$ of each air conditioner using Equation 7, which is stored to a variable as the power consumption for the relevant combination No. in the data storage section 101.

[Equation 7]

$$W_{all} = \sum_{k=1}^{4} W_k \quad \text{(Equation 7)}$$

In FIG. 12, for example, it is assumed that combination No. 5 is currently selected. In this case, the air conditioners Nos. 1 and 3 are assumed to be operated, while the air conditioner 2 is assumed to be shut down.

Air conditioning capability $Q_1$ and $Q_3$ are determined for the air conditioners Nos. 1 and 3, respectively, through calculation described in step S205.

The operable machine selection calculating section 110 calculates the total power consumption $W_{all}$ from the power consumption W of the air conditioners Nos. 1 and 3 using Equation 7. Specifically, the total power consumption $W_{all}$ is as follows (Equation 8):

[Equation 8]

$$W_{all}=a_1Q_1^2+b_1Q_1+c_1)+(a_3Q_3^2+b_3Q_3+c_3) \quad \text{(Equation 8)}$$

(S207)

In combination selection completion determination processing step S207, the operable machine selection calculating section 110 determines whether processing has been completed for all of the combinations.

(S208)

If processing has not been completed, the flow proceeds to unselected combination selection processing step S208 where the next combination is selected from among unselected combinations and returns to step S205 where processing is repeated.

If the selection of all of the combinations and the calculation for the combinations have been completed, the flow proceeds to final combination selection processing step S209.

(S209)

In the final combination selection processing step S209, the total power consumption $W_{all}$ for all of the combinations are referenced from the data storage section 101 and a combination that leads to, for example, the smallest total power consumption $W_{all}$ is selected. Then, thus selected combination No. is stored to a variable in the data storage section 101.

(S210)

In control signal sending processing step S210, the control signal sending section 106 reads an air conditioner and air conditioning capability value corresponding to a combination number selected in step S209 above from the data storage section 101.

Then, a control signal to implement an operating status, such as balanced operation and balanced shutdown, and such an air conditioning capability value are sent through a communication line in synchronization with the next control timing.

(S211)

In end processing step S211, a series of calculation processing steps are completed.

The coordinated control described above provides a required overall air conditioning load L by assigning an operating status and air conditioning capability to each of the air conditioners so as to reduce power consumption. This enables air conditioner control through determination of operational conditions which reduce power consumption as the entire air conditioner system.

As described above, this Embodiment determines the air conditioning capability of air conditioners to be operated so that the sum of air conditioning capability of the air conditioners to be operated is the overall air conditioning load L and the sum of power consumption of the air conditioners to be operated is minimum, and selects a combination of the air conditioners to be operated, which leads to a minimum in the sum of their power consumption.

This allows the control of air conditioners through a combination of air conditioners to be operated or to be shut down, which results in a minimum in the total power consumption $W_{all}$ while the balance between the overall air conditioning load L in the space subjected to air conditioning 1 and the sum of air conditioning capability $Q_k$ of air conditioners to be operated is maintained.

Accordingly, this allows proper air conditioning capability and number of air conditioners to be operated to be determined on an integral basis to achieve less power consumption, thereby reducing energy consumption.

In cases where a measured air conditioning load data value for an air conditioner is small and such an air conditioning load value is smaller than the minimum capability of such an air conditioner, operating status and air conditioning capability controlled separately by a plurality of air conditioners results in repeated air conditioner thermostat on and off events, leading to significantly ineffective energy consumption for the air conditioning load.

Coordinated control by a plurality of air conditioners according to Embodiment 2 allows operating status and air conditioning capability to be determined on the basis of the overall air conditioning load obtained from the sum of measured air conditioning load data of each air conditioner, which prevents air conditioners from producing repeated thermostat on and off events independently of each other, ensuring minimum thermostat on and off events for the necessary overall air conditioning load. This enables air conditioners to be controlled so as to ensure effective energy consumption especially for lower air conditioning load.

Although in Embodiment 2 coordinated control processing by a plurality of air conditioners is described using a flowchart shown in FIG. 10, such a flowchart may be implemented by a program that substantially performs such coordinated control processing. Although such a program is stored in a remote control microcomputer serving as the control device 10, it is conceivable that such a program is stored in, for example, a hard disk serving as a recording medium if the control device 10 consists of a computer, instead of a remote control device.

Also, a computer readable medium recording such a program may include a CD-ROM or MO or the like, in addition to a hard disk.

Furthermore, the program itself may be obtained via an electrical communication line without via a recording medium.

Embodiment 3

Embodiment 3 is characterized in that, in addition to the features of the control device 10 according to Embodiment 2, a feature for selecting an air conditioner to be operated is provided which allows for power consumption associated with balanced shutdown (temporary suspension of compressor operation).

The overall configuration of an air conditioning system required for a control device 10 according to Embodiment 3 is the same as that shown in FIG. 1.

The flowchart illustrating coordinated control processing by a plurality of air conditioners according to Embodiment 3 of the present invention is the same as that shown in FIG. 10, except that step S206 is executed for allowing for power consumption associated with balanced shutdown.

Differences from Embodiment 2 (FIG. 10) are described below.

In Embodiment 2 above, power consumption $W_{all}$ of only air conditioners in operation is calculated to select a combination, as shown in Equation 8.

Actually, however, in an air conditioner in a balanced shutdown status under coordinated control, its indoor blower fan 22 of the indoor unit 2 is working, and a control function for restarting the air conditioner is operating, consuming electric power.

Power consumption W of an air conditioner in a balanced shutdown status under coordinated control is named as $W^{OFF}$ [kW], which is specifically described using, for example, FIG. 12, in the same manner as Embodiment 2.

$W^{OFF}$ is specified for each of the air conditioners and is stored in the data memory section 102 in a data format, an expanded performance model data, shown in FIG. 13, and is referenced by calculation when needed.

It is assumed that combination No. 5 is currently selected. In this case, the air conditioners Nos. 1 and 3 are assumed to be operated, while the air conditioner 2 is assumed to be shut down.

The operable machine selection calculating section 110 calculates the total power consumption $W_{all}$ from the power consumption W of all the air conditioners using Equation 7.

Specifically, the total power consumption $W_{all}$ according to Embodiment 3 is as follows (Equation 8):

[Equation 9]

$$W_{all}=(a_1Q_1^2+b_1Q_1+c_1)+(a_3Q_3^2+b_3Q_3+c_3)+W_2^{OFF} \quad \text{(Equation 9)}$$

Using the total power consumption $W_{all}$ which allows for power consumption associated with balanced shutdown above, various combinations are evaluated by comparison to determine a final combination in the same manner as Embodiment 2 above.

In other words, the operable machine selection calculating section 110 selects a combination which leads to a minimum in the sum of power consumption W of air conditioners to be operated and stand-by power consumption $W^{OFF}$ of air conditioners to be shut down.

As described above, this Embodiment provides a required overall air conditioning load by assigning an operating status and air conditioning capability to each of the air conditioners so as to reduce the total power consumption, allowing for the power consumption associated with balanced shutdown (temporary shutdown of the compressor).

This has an advantage of air conditioner control through determination of actual operating status so as to achieve a reduction in power consumption as an entire air conditioning system.

Although in Embodiment 2 coordinated control processing by a plurality of air conditioners is described using a flowchart shown in FIG. 10, such a flowchart may be implemented by a program that substantially performs such coordinated control processing. Although such a program is stored in a remote control microcomputer serving as the control device 10, it is conceivable that such a program is stored in, for example, a hard disk serving as a recording medium if the control device 10 consists of a computer, instead of a remote control device.

Also, a computer readable medium recording such a program may include a CD-ROM or MO or the like, in addition to a hard disk.

Furthermore, the program itself may be obtained via an electrical communication line without via a recording medium.

Embodiment 4

Embodiment 4 is characterized in that operating status for reducing power consumption are determined by considering that the relationship between air conditioning capability and power consumption varies with a change in temperatures inside a space subjected to air conditioning 1 (hereinafter may be referred to as "indoor temperature") and temperatures outside a space subjected to air conditioning 1 (hereinafter may be referred to as "outdoor temperature").

The overall configuration of an air conditioning system required for a control device 10 according to Embodiment 4 is the same as that shown in FIG. 1.

As described in Embodiment 1 above, the relationship between air conditioning capability and power consumption of an air conditioner is approximated by a quadratic equation such as Equation 1 above.

However, the power consumption related to air conditioning capability varies with a change in indoor and outdoor temperatures.

Assuming that an relational equation of air conditioning capability $Q_k$ and power consumption $W_k$ at a reference temperature (26 degree C., for example) for an air conditioner k has coefficient data named as $a_{base,\ k}$, $b_{base,\ k}$, $c_{base,\ k}$, the power consumption Wk (kW) related to a certain indoor temperature and outdoor temperature can be represented by the following Equation 10.

At this time, coefficient data subjected to correction according to the indoor temperature and the outdoor temperature is named as $a'_k$, $b'_k$, $c'_k$.

[Equation 10]

$$W_k = \left(a_{base,k} \times \frac{\eta^q}{\eta^w}\right) \cdot Q_k^2 + \left(b_{base,k} \times \frac{\eta^q}{\eta^w}\right) \cdot Q_k + \left(c_{base,k} \times \frac{\eta^q}{\eta^w}\right) = a'_k \cdot Q_k^2 + b'_k \cdot Q_k + c'_k \quad \text{(Equation 10)}$$

where $\eta^q$ refers to a capacity correction coefficient related to a certain indoor temperature and outdoor temperature, while $\eta^w$ refers to an input correction coefficient related to a certain indoor temperature and outdoor temperature.

Coordinated control according to Embodiment 4 allowing for the effect of indoor and outdoor temperatures is described below.

The flowchart illustrating coordinated control processing by a plurality of air conditioners according to Embodiment 4 of the present invention is the same as those shown in Embodiment 1 (FIG. 8) and Embodiment 2 (FIG. 10), except that steps S104 and S107, or step S206 is executed using corrected coefficients for allowing for the effect of indoor and outdoor temperatures on each of candidate air conditioners.

Differences from Embodiment 1 (FIG. 8) and Embodiment 2 and 3 (FIG. 10) are described below.

For coefficient data of performance model data D101 according to Embodiment 4, coefficient data $a_{base,\ k}$, $b_{base,\ k}$, $c_{base,\ k}$ at a certain reference temperature (26 degree C., for example) is specified for each air conditioner.

The air conditioning capability allocation calculating section 105 according to Embodiment 4 obtains capacity correction coefficient $\eta^q$ and input correction coefficient $\eta^w$ on the basis of indoor temperatures and outdoor temperatures.

In Embodiment 4, indoor temperature and outdoor temperature are associated with condensation temperature and evaporation temperature, respectively.

In other words, for cooling operation, the evaporation temperature of the indoor heat exchanger 21 sensed by the temperature sensor 23 is determined as an indoor temperature, while the condensation temperature of the outdoor heat exchanger 33 sensed by the temperature sensor 36 is determined as an outdoor temperature.

Also, for heating operation, the condensation temperature of the indoor heat exchanger 21 sensed by the temperature sensor 23 is determined as an indoor temperature, while the evaporation temperature of the outdoor heat exchanger 33 sensed by the temperature sensor 36 is determined as an outdoor temperature.

Then, the air conditioning capability allocation calculating section 105 obtains capacity correction coefficient $\eta^q$ and input correction coefficient $\eta^w$ predetermined according to the evaporation temperature and the condensation temperature.

For example, a table having correction coefficient values corresponding to the evaporation temperature and the condensation temperature set is stored in advance in the data storage section 101, from which correction coefficients are referenced.

Then, on the basis of thus obtained capacity correction coefficient $\eta^q$ and input correction coefficient $\eta^w$, the air conditioning capability allocation calculating section 105 makes a correction to the performance model data D101 using Equation 10.

Consequently, the air conditioning capability allocation calculating section 105 stores the corrected coefficient data $a'_k$, $b'_k$, $c'_k$ as new performance model data D101 in the data memory section 102 in the data format shown in FIG. 14, which is referenced when needed.

The coefficients above are obtained from the condensation temperature and the evaporation temperature, but are not limited to this. Sensors and the like may be provided to detect indoor temperatures and outdoor temperatures.

Determination of correction coefficients from indoor temperatures and outdoor temperatures is described above, but not limited to this. On the basis of either one of the indoor temperature and the outdoor temperature, correction coefficients may be determined to correct the coefficient of the performance model data.

Given that a relational equation of air conditioning capability and power consumption is represented by Equation 10, new coefficient data $a'_k$, $b'_k$, $c'_k$ may be substituted for the coefficient data in Equation 5 and Equation 6, which allocate air conditioning capability for a plurality of air conditioners to meet the overall air conditioning load at minimum power consumption at a certain indoor and outdoor temperature, as described in Embodiment 1.

Likewise, new coefficient data $a'_k$, $b'_k$, $c'_k$ may be substituted for the coefficient data in Equation 8 and Equation 9, which represent the total power consumption at the time of selection of air conditioners to be operated at a certain indoor and outdoor temperature, as described in Embodiments 2 and 3.

As described above, this Embodiment makes a correction to the performance model data on the basis of indoor temperatures and outdoor temperatures. For this reason, the coordinated control by a plurality of air conditioners according to Embodiment 4 can meet the required overall air conditioning load by assigning operating status and air conditioning capability to each air conditioner so as to reduce power consumption, allowing for the relationship between air conditioning capability and power consumption that varies with the effect of indoor temperatures and outdoor temperatures.

Accordingly, this has an advantage of air conditioner control through determination of operating status reflecting actual indoor environment and installation environment of outdoor units, thereby ensuring reduction in energy consumption.

Correction coefficients are determined according to refrigerant evaporation temperatures and condensation temperatures, and a correction is made to coefficients of the performance model data D101 on the basis of these correction coefficients.

Since aging of air conditioning cycles has an effect on evaporation temperatures and condensation temperatures, the coordinated control by a plurality of air conditioners according to Embodiment 4 allows the effect of aged air conditioners to be dynamically reflected in operating status and air conditioning capability of operating air conditioners.

Accordingly, this has an advantage of controlling a plurality of air conditioners by determining operating status and air conditioning capability for each air conditioner so as to achieve a reduction in power consumption, allowing for different degrees of deterioration resulting from different frequencies of use and the mix of different air conditioners having different periods of use since installed new.

Embodiment 5

Embodiment 5 is characterized in that, for the growing number of candidate air conditioners, the number of combinations of operating statuses to be created on the basis of the candidate air conditioners is reduced in order to determine an effective operating status under lower calculation load.

The overall configuration of an air conditioning system required for a control device 10 according to Embodiment 5 is the same as that shown in FIG. 1.

As described in Embodiment 2 above, in step S212 the operable machine selection calculating section 110 generates a list of all the combinations which can be generated using candidate air conditioners.

For example, the number of combinations to be created using the candidate air conditioners Nos. 1, 2, and 3 given in FIG. 11 is seven in total, as shown in FIG. 12.

Increasing number of candidate air conditioners result in greater number of combinations. As a result, calculation of the total power consumption for all of the combinations leads to increased calculation load. Reduction of the number of combinations is necessary to reduce the calculation load.

At this time, candidate air conditioners having higher operation efficiency may be preferentially selected into the combinations, thereby reducing the total number of combinations.

Figure 15:
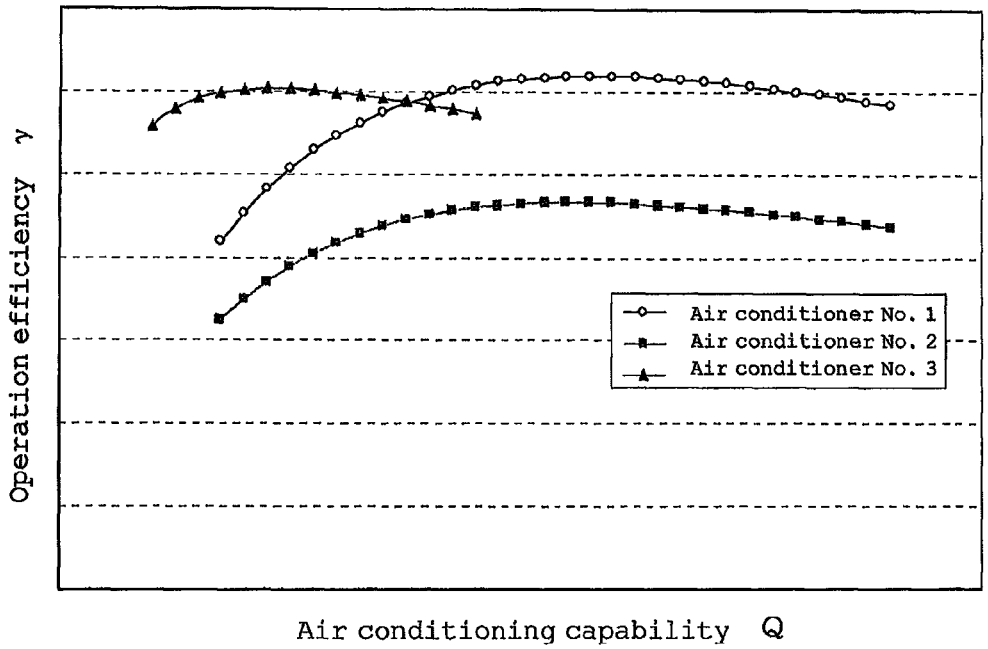
FIG. 15 is a graph showing the relationship between air conditioning capability and operation efficiency for each air conditioner.

FIG. 15 is a graph showing the relationship between air conditioning capability and operation efficiency for each air conditioner.

As shown in FIG. 15, the relationship between air conditioning capability and operation efficiency varies with a particular air conditioner. Accordingly, the order of air conditioner operation efficiency depends on air conditioning capability Q to be set to a particular air conditioner.

In the coordinated control described in Embodiments 1 through 4 above, however, such air conditioning capability is allocated to each air conditioner in such a manner that intermediate variables μ are equal.

Figure 16:
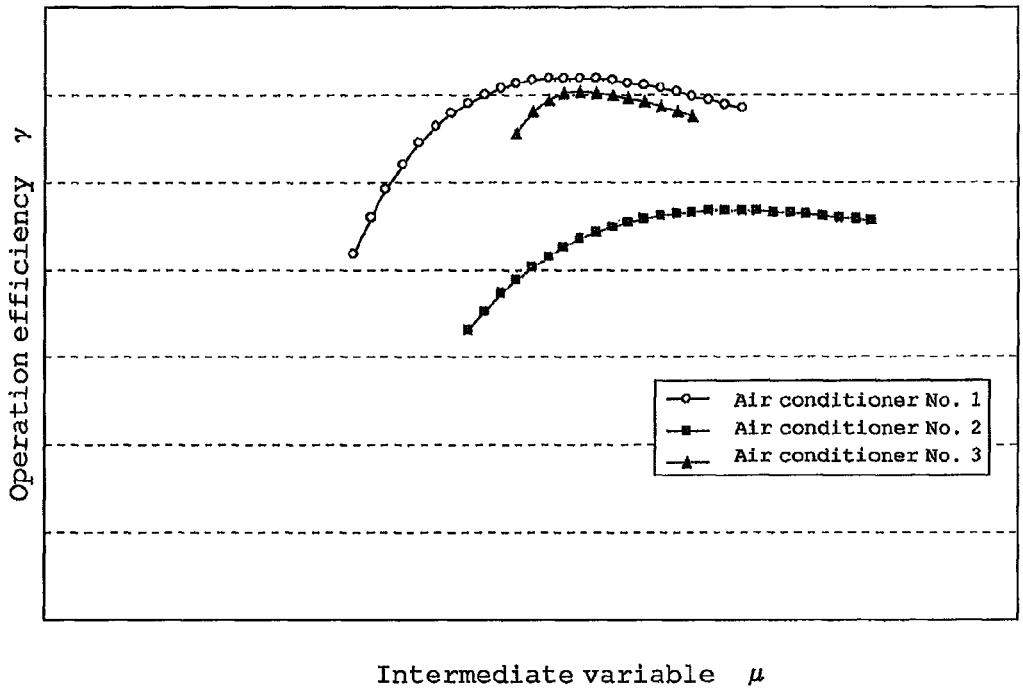
FIG. 16 is a graph of operation efficiency of FIG. 15, in which the abscissa is indicated by intermediate variable $\mu$.

An efficiency curve of FIG. 15 can be plotted as shown in FIG. 16, in which the abscissa is indicated by intermediate variable μ.

As shown in FIG. 16, if an intermediate variable μ is constant, it is conceivable that the order of operation efficiency of air conditioners may be the order of air conditioners having greater maximum efficiency.

However, this is not always correct if efficiency curves cross.

Maximum operation efficiency (hereinafter referred to as "maximum operation-efficiency $\gamma^{max}$) for each air conditioner is calculated from the result above, and a combination of air conditioners may be considered on the basis of the order of such maximum operation efficiency $\gamma^{max}$.

When the relationship between air conditioning capability and operation efficiency for each air conditioner can be approximated using a quadratic equation like Equation 1, operation efficiency $\gamma_k$ for an air conditioner k is given by the following Equation 11.

[Equation 11]

$$\gamma_k = \frac{Q_k}{W_k} = \frac{Q_k}{a_k \cdot Q_k^2 + b_k \cdot Q_k + c_k} \quad \text{(Equation 11)}$$

At this time, the maximum operation efficiency $\gamma^{max}$ is given by Equation 12.

A typical graph of maximum operation efficiency $\gamma^{max}$ is shown in FIG. 17, in which a mark "x" indicates the maximum operation efficiency $\gamma^{max}$.

[Equation 12]

$$\gamma_k^{max} = \frac{1}{b_k + 2\sqrt{a_k c_k}} \quad \text{(Equation 12)}$$

In addition, as described in Embodiment 4, since operation efficiency is subject to an effect of indoor temperatures or outside temperatures, it is necessary to properly determine the operation efficiency which reflects such an effect.

This embodiment determines the operation efficiency by considering the effect of indoor temperatures or outside temperatures.

Considering the effect of indoor temperatures or outside temperatures, Equation 12 can be expressed in the following manner when the maximum operation efficiency of an air conditioner k at a reference temperature (26 degree C., for example) is named as $\gamma^{max}{}_{base,\,k}$.

[Equation 13]

$$\gamma_k^{max} = \frac{1}{b_k + 2\sqrt{a_k c_k}} = \frac{1}{b_{base,k} + 2\sqrt{a_{base,k} c_{base,k}}} \cdot \frac{\eta_k^w}{\eta_k^q} = \gamma_{base,k}^{max} \cdot \frac{\eta_k^w}{\eta_k^q} \quad \text{(Equation 13)}$$

Coordinated control according to Embodiment 4 is described below which reduces the number of combinations on the basis of the order of operation efficiency above.

The flowchart illustrating coordinated control processing by a plurality of air conditioners according to Embodiment 5 of the present invention is the same as that shown in FIG. 10 of Embodiment 2, except that in step S212 a list of operating status combinations is created for each air conditioner on the basis of the maximum operation efficiency reflecting indoor temperatures and outdoor temperatures.

Differences from Embodiments 2 through 4 (FIG. 10) are described below.

FIG. 18 is a chart showing the data format of expanded performance model data according to Embodiment 5.

Expanded performance model data including $\gamma^{max}{}_{base}$ specified for each air conditioner is stored in the data memory section 102 in the data format in FIG. 18, which is referenced by calculation when needed.

For application to Embodiment 3, the performance model data shown in FIG. 13 may be expanded in the same manner.

The operable machine selection calculating section 110 according to this Embodiment calculates the maximum operation efficiency for each candidate air conditioner from coefficients $\eta^q$ and $\eta^w$, determined at calculation timing from indoor temperatures and outdoor temperatures using Equation 13 in step S212, and $\gamma^{max}{}_{base}$ stored in the data memory section 102.

Then, candidate air conditioners are arranged in descending order of maximum operation efficiency and are sequentially selected into combinations to create a combination list, beginning with the first candidate air conditioner.

At this time, preferably the number of combinations to be created when the number of air conditioners is "N" is reduced to, for example, "N".

In other words, a combination is determined which ensures that an air conditioner with the greatest maximum operation efficiency is included in a combination of air conditioners to be operated.

Specifically, it is assumed that candidate air conditioners include air conditioners No. 1, 2, and 3.

Also, it is assumed that the maximum operation efficiency determined for candidate air conditioners is "2.7" for air conditioner No. 1, "3.0" for air conditioner No. 2, and "2.3" for air conditioner No. 3.

In this case, candidate air conditioners arranged in descending order of maximum operation efficiency include air conditioners No. 2, No. 1, and No. 3 in that order.

Accordingly, a combination list is created as shown in FIG. 19.

As described above, if the number of candidate air conditioners is "N", power consumption is calculated for "N" combinations of air conditioners arranged in descending order of maximum operation efficiency.

Subsequently, as is the case for Embodiment 2 above, operating status and air conditioning capability may be set on the basis of any of all the combinations, which gives a minimum in the total power consumption.

As described above, this Embodiment determines a combination of air conditioners to be operated and those to be shut down from a plurality of air conditioners on the basis of the order of the maximum operation efficiency.

Accordingly, this Embodiment allows the number of combinations of candidate air conditioner operating statuses to be effectively reduced when air conditioner operating status and air conditioning capability are determined by calculation for reduction in power consumption.

Reduced number of combinations of candidate air conditioner operating statuses leads to a reduced calculation load, thereby allowing coordinated control processing to be installed in even a microcomputer having degraded calculation capability due to practical restriction and having limited memory.

Embodiment 6

Embodiment 6 is characterized in that a user can pre-set an air conditioner to be subjected to coordinated control, or that a user can pre-set an air conditioner to go out of coordinated control.

The overall configuration of an air conditioning system required for a control device 10 according to Embodiment 6 is the same as that shown in FIG. 1.

The status to cause an air conditioner to go out of coordinated control includes two statuses, one causing the main power to be switched off and the other causing such an air conditioner to perform operation not subjected to coordinated control.

Information as to whether each of a plurality of air conditioners is subjected to coordinated control is stored in the data storage section 101.

Like Embodiment 1 described above, coordinated control by a plurality of air conditioners is carried out as follows:

When a user shuts down a certain air conditioner, such a user switches off the main power of such an air conditioner. At this time, the operating status of main power off is given from such an air conditioner to the control device 10 through a communication line. Then, in the operation information data D103 "−1" is assigned to such an air conditioner and stored in the data storage section 101.

For example, when air conditioners Nos. 1, 2, and 3 are caused to operate and air conditioner No. 4 is caused to shut down, data shown in FIG. 20 is set.

If a user wants a certain air conditioner to perform operation not subjected to coordinated control, the status of operation not subjected to coordinated control is set to such an air conditioner.

In other words, "−2" is assigned to such an air conditioner through user setting in the operation information data D103 and stored in the data storage section 101.

For example, when air conditioners Nos. 1, 2, and 3 are caused to operate and air conditioner No. 4 is caused to perform operation not subjected to coordinated control, data shown in FIG. 21 is set.

Then, coordinated control processing is performed in accordance with the flowchart shown in FIG. 8.

In other words, the overall air conditioning load calculating section 104 calculates overall air conditioning load L that is the sum of air conditioning loads of air conditioners subjected to control.

Also, from a plurality of air conditioners the air conditioning capability allocation calculating section 105 determines the air conditioning capability for each air conditioner so that the sum of air conditioning capability of air conditioners subjected to control is equal to the overall air conditioning load L and that the sum of power consumption of air conditioners subjected to control is minimum.

Other operations are the same as those in Embodiment 1 (FIG. 8).

As is the case with Embodiment 2, for a plurality of air conditioners in operation, selection of air conditioners to be operated and allocation of air conditioning capability are implemented as follow.

When a user shuts down a certain air conditioner, such a user switches off the main power of such an air conditioner. At this time, the operating status of main power off is given from such an air conditioner to the control device 10 through a communication line. Then, in the operation information data D201 "−1" is assigned to such an air conditioner and stored in the data storage section 101.

For example, if air conditioners to be operable at the next control timing are air conditioners Nos. 1 and 2, and an air conditioner to be operable is air conditioner No. 3, and an air conditioner in the power off operating status is air conditioner No. 4, then the data shown in FIG. 22 is set.

If a user wants a certain air conditioner to perform operation not subjected to coordinated control, the status of operation not subjected to coordinated control is set to such an air conditioner.

In other words, "−2" is assigned to such an air conditioner in the operation information data D201 and stored in the data storage section 101.

For example, when air, conditioners Nos. 1, 2, and 4 are caused to operate and air conditioner No. 3 is caused to perform operation not subjected to coordinated control, the data shown in FIG. 23 is set.

Then, coordinated control processing is performed in accordance with the flowchart shown in FIG. 10.

In other words, the overall air conditioning load calculating section 104 calculates overall air conditioning load L that is the sum of air conditioning loads of air conditioners subjected to control.

Also, the air conditioning capability allocation calculating section 105 determines the air conditioning capability for each air conditioner so that the sum of air conditioning capability of air conditioners subjected to control is equal to the overall air conditioning load L and that the sum of power consumption of air conditioners subjected to control is minimum.

Other operations are the same as those in Embodiment 2 (FIG. 10).

Likewise, in Embodiments 3 through 5, air conditioners subjected to control, which goes into coordinated control, can also be set so as to perform coordinated control on the basis of the information of the data storage section 101.

As described above, information as to whether each of a plurality of air conditioners is subjected to coordinated control is stored in the data storage section 101 in this Embodiment.

For this, the coordinated control by a plurality of air conditioners according to Embodiment 6 allows a user to set whether an appropriate air conditioner is subjected to coordinated control.

Also, even if some air conditioners provided in a place needing no air conditioning is powered off under certain circumstances, coordinated control can be continued by the other air conditioners.

Furthermore, even if some air conditioners provided in a place needing air conditioner are set to perform operation not subjected to coordinated control under certain circumstances regardless of air conditioner performance or environmental conditions, coordinated control can be continued by the other air conditioners.

As described above, this Embodiment has an advantage of providing a flexible control to meet users' energy-saving setting or needs for comfort.

Embodiment 7

Embodiment 7 is characterized in that some air conditioners subjected to coordinated control are caused to go out of the coordinated control and to operate independently of the other when information from a sensor provided at a location is largely different from settings.

The overall configuration of an air conditioning system required for a control device 10 according to Embodiment 7 is the same as that shown in FIG. 1.

This Embodiment handles as sensor information the temperature (air conditioning load) in a location where an air conditioner subjected to coordinated control is installed, which is described below.

As is the case with Embodiment 1 above, allocation of air conditioning capability to a plurality of air conditioners in operation is implemented as follow.

In initial data read processing step S102, the data setting section 103 references the operation information data D103 for air conditioners in the balanced operation and balanced shutdown statuses at the next control timing in accordance with the flowchart shown in FIG. 8.

Also, the data setting section 103 references the air conditioning load data D102 for air conditioners in the balanced operation (operation information data D103 is "1") and balanced shutdown (operation information data D103 is "0") statuses.

At this time, if the magnitude of the air conditioning load data D102 for air conditioners currently in balanced operation or balanced shutdown status is greater than a predetermined value ($L^{TH}$ (kW), for example), a value "1" or "0" being currently in the operation information data D103 is corrected to "−2" (not subjected to coordinated control).

Since the difference between the indoor temperature and the set temperature is reflected in then air conditioning load, the magnitude of air conditioning load is used as judgment criteria. Also, the deviation between the indoor temperature and the set temperature may be used as judgment criteria.

A series of processing steps following the correction to the operation information data D103 are the same as those following step S103 in the flowchart in FIG. 8 based on the corrected operation information data D103.

In other words, from among a plurality of air conditioners the overall air conditioning calculating section 104 selects an air conditioner having a smaller air conditioning load than a predetermined value ($L^{TH}$ (kW), for example) as an air conditioner subjected to control, calculating the overall air conditioning load L that is the sum of air conditioning loads of the air conditioners subjected to control.

Also, from a plurality of air conditioners the air conditioning capability allocation calculating section 105 determines the air conditioning capability for each air conditioner so that the sum of air conditioning capability of air conditioners subjected to control is equal to the overall air conditioning load L and that the sum of power consumption of air conditioners subjected to control is minimum.

As is the case with Embodiment 2, for a plurality of air conditioners in operation, selection of air conditioners to be operated and allocation of air conditioning capability are implemented as follow.

In initial data read processing step S202, the data setting section 103 references the operable information data D201 for candidate air conditioners at the next control timing in accordance with the flowchart shown in FIG. 10.

Also, the data setting section 103 references the air conditioning load data D102 for air conditioners in the balanced operation (operable information data D201 is "1") and balanced shutdown (operable information data D201 is "0") statuses.

At this time, if the magnitude of the air conditioning load data D102 for air conditioners currently in balanced operation or balanced shutdown status is greater than a predetermined value ($L^{TH}$ (kW), for example), a value "1" or "0" being currently in the operable information data D201 is corrected to "−2" (not subjected to coordinated control).

Since the difference between the indoor temperature and the set temperature is reflected in then air conditioning load, the magnitude of air conditioning load is used as judgment criteria. Also, the deviation between the indoor temperature and the set temperature may be used as judgment criteria.

A series of processing steps following the correction to the operation information data D201 are the same as those following step S203 in the flowchart in FIG. 10 based on the corrected operable information data D201.

In other words, from among a plurality of air conditioners the overall air conditioning calculating section 104 selects an air conditioner having a smaller air conditioning load than a predetermined value ($L^{TH}$ (kW), for example) as an air conditioner subjected to control, calculating the overall air conditioning load L that is the sum of air conditioning loads of the air conditioners subjected to control.

Also, from a plurality of air conditioners the air conditioning capability allocation calculating section 105 determines the air conditioning capability for each air conditioner so that the sum of air conditioning capability of air conditioners subjected to control is equal to the overall air conditioning load L and that the sum of power consumption of air conditioners subjected to control is minimum.

Also, in Embodiments 3 through 6, when the air conditioning load of air conditioners is greater than a predetermined value ($L^{TH}$ (kW), for example), the operation information data D103 or the operable information data D201 is corrected to "−2" (not subjected to coordinated control), thereby performing the same operation.

As described above, this Embodiment determines an air conditioner having a greater air conditioning load than a predetermined value ($L^{TH}$ (kW), for example) as an air conditioner not subjected to control, and determines an air conditioner having a smaller air conditioning load than a predetermined value ($L^{TH}$ (kW), for example) as an air conditioner subjected to control.

For this reason, if there is a large temperature difference between a room temperature and a set temperature in an air-conditioner area mainly covered by an air conditioner, the coordinate control by a plurality of air conditioners according to Embodiment 7 allows such an air conditioner to go out of coordinated control and to focus on such an air-conditioner area.

This has an advantage of providing a flexible control to cope with an uncomfortable situation.

Although an air conditioner control device 10 for controlling a plurality of air conditioners is described in Embodiments 1 through 7 above, Embodiments 1 through 7 can be applied to a refrigerator control device for controlling a plurality of refrigerators installed for air-conditioning a common space.

For example, in a system having a plurality of refrigerators for refrigerating a showcase using an indoor heat exchanger 21, performance model data representing the relationship between refrigerating capability and power consumption is stored for each of a plurality of refrigerators, and the overall refrigerating load that is the sum of refrigerating loads of a plurality of refrigerators is determined.

Then, on the basis of the performance model data and the overall refrigerating load, a refrigerating capability is determined for each of a plurality of refrigerators so that the sum of the refrigerating capability of a plurality of refrigerators is equal to the overall refrigerating load and that the sum of the power consumption of a plurality of refrigerators is minimum, thereby providing the same coordinated control as Embodiments 1 through 7 above. This attains reduction in the total power consumption while the balance between the overall refrigerating load and the sum of refrigerating capability of refrigerators is maintained.

REFERENCE SIGNS LIST

1: space subjected to air conditioning
2: indoor unit
3: outdoor unit
10: control device
21: indoor heat exchanger
22: indoor blower fan
23: temperature sensor
31: compressor
32: four-way valve
33: outdoor heat exchanger
34: outdoor blower fan
35: throttle device
36: temperature sensor
100: operation controlling means
101: data storage section
102: data memory section
103: data setting section
104: overall air conditioning load calculating section
105: air conditioning capability allocation calculating section
106: control signal sending section
110: operable machine selection calculating section

The invention claimed is:

1. An air-conditioning apparatus control device that controls a plurality of air-conditioning apparatuses provided for air-conditioning a common space, comprising:

data memory means for storing performance model data representing a relationship between air conditioning capability and power consumption for each of said plurality of air-conditioning apparatuses;

overall air conditioning load calculating means for calculating an overall air conditioning load that is the sum of air conditioning loads of said plurality of air-conditioning apparatuses;

air conditioning capability allocation calculating means for determining the air conditioning capability for each of said plurality of air-conditioning apparatuses on the basis of said performance model data and said overall air conditioning load so that the sum of the air conditioning capability of said plurality of air-conditioning apparatuses is equal to said overall air conditioning load and that the sum of the power consumption of said plurality of air-conditioning apparatuses is minimum;

control signal sending means for sending a control signal related to said air conditioning capability to each of said plurality of air-conditioning apparatuses, and an operable air-conditioning apparatus selection means for determining combination patterns of air-conditioning apparatuses to be operated, air-conditioning apparatuses to be shut down from among said plurality of air-conditioning apparatuses, a maximum value of operation efficiency for each of said plurality of air-conditioning apparatuses respectively, on the basis of said performance model data, and, from said plurality of air-conditioning apparatuses, combination patterns of air-conditioning apparatuses to be operated and air-conditioning apparatuses to be shut down on the basis of an order of the maximum values of said operating efficiencies such that air-conditioning apparatuses having higher maximum values of said operating efficiencies are to be operated and air-conditioning apparatuses having lower maximum values of said operating efficiencies are to be shut down;

wherein for each of said combination patterns said air conditioning capability allocation calculating means determines air conditioning capability of said air-conditioning apparatuses to be operated so that the sum of air conditioning capability of said air-conditioning apparatuses to be operated is equal to said overall air conditioning load and that the sum of power consumption of said air-conditioning apparatuses to be operated is minimum;

wherein from among said combination patterns said operable air-conditioning apparatus selection means selects a combination pattern which causes the sum of power consumption of said air-conditioning apparatuses to be operated to be minimum at said air conditioning capability determined by said air conditioning capability allocation calculating means; and wherein according to said combination pattern thus selected said control signal sending means sends a control signal related to an operating status and said air conditioning capability to each of said plurality of air-conditioning apparatuses.

2. The air-conditioning apparatus control device of claim 1, wherein, on the basis of said performance model data, said air conditioning capability allocation calculating means determines the sum of power consumption of said plurality of air-conditioning apparatuses as a multivariable function where variables are air conditioning capability for each air-conditioning apparatus, and determines an air conditioning capability of each of said air-conditioning apparatuses, which causes said multivariable function to give an extreme value, under a limiting condition that the sum of air conditioning capability of said plurality of air-conditioning apparatuses is said overall air conditioning load.

3. The air-conditioning apparatus control device of claim 1, wherein, in a second multivariable function in which an intermediate variable having a coefficient of said limiting condition is added to said multivariable function, said air conditioning capability allocation calculating means determines a said intermediate variable that meets a condition under which each variable of said second multivariable function gives an extreme value, and determines air conditioning capability of each of said air conditioners on the basis of said intermediate variable and said performance model data.

4. An air-conditioning apparatus control device that controls a plurality of air-conditioning apparatuses provided for air-conditioning a common space, comprising:

data memory means for storing performance model data representing a relationship between air conditioning capability and power consumption for each of said plurality of air-conditioning apparatuses;

overall air conditioning load calculating means for calculating an overall air conditioning load that is the sum of air conditioning loads of said plurality of air-conditioning apparatuses;

air conditioning capability allocation calculating means for determining the air conditioning capability for each of said plurality of air-conditioning apparatuses on the basis of said performance model data and said overall air conditioning load so that the sum of the air conditioning capability of said plurality of air-conditioning apparatuses is equal to said overall air conditioning load and that the sum of the power consumption of said plurality of air-conditioning apparatuses is minimum; and control signal sending means for sending a control signal related to said air conditioning capability to each of said plurality of air-conditioning apparatuses, wherein said air conditioning capability allocation calculating means determines the sum of power consumption of said plurality of air-conditioning apparatuses as a multivariable function where variables are air conditioning capability for each air-conditioning apparatus, and determines an air conditioning capability of each of said air-conditioning apparatuses, which causes said multivariable function to give an extreme value, under a limiting condition that the sum of air conditioning capability of said plurality of air-conditioning apparatuses is said overall air conditioning load, in a second multivariable function in which an intermediate variable having a coefficient of said limiting condition is added to said multivariable function, said air conditioning capability allocation calculating means determines intermediate variable that meets a condition under which each variable of said second multivariable function gives an extreme value, and determines air conditioning capability of each of said air conditioners on the basis of said intermediate variable and said performance model data, and said intermediate variable is a Lagrange multiplier of said multivariable function that represents maintenance of a balance of said overall air conditioning load and the sum of the air conditioning capability of each of said plurality of air-conditioning apparatuses.

5. The air-conditioning apparatus control device of claim 4, wherein an operable air-conditioning apparatus selection means is provided for determining combination patterns of air-conditioning apparatuses to be operated and air-conditioning apparatuses to be shut down from among said plurality of air-conditioning apparatuses;

wherein for each of said combination patterns said air conditioning capability allocation calculating means determines air conditioning capability of said air-conditioning apparatuses to be operated so that the sum of air conditioning capability of said air-conditioning apparatuses to be operated is equal to said overall air conditioning load and that the sum of power consumption of said air-conditioning apparatuses to be operated is minimum;

wherein from among said combination patterns said operable air-conditioning apparatus selection means selects a combination pattern which causes the sum of power consumption of said air-conditioning apparatuses to be operated to be minimum at said air conditioning capability determined by said air conditioning capability allocation calculating means; and wherein according to said combination pattern thus selected said control signal sending means sends a control signal related to an operating status and said air conditioning capability to each of said plurality of air-conditioning apparatuses.

6. The air-conditioning apparatus control device of claim 5, wherein from among said combination patterns said operable air-conditioning apparatus selection means selects a combination pattern which causes the sum of power consumption of said air-conditioning apparatuses to be operated and power consumption during a stand-by of said air-conditioning apparatuses to be shut down to be minimum at said air conditioning capability determined by said air conditioning capability allocation calculating means.

7. The air-conditioning apparatus control device of claim 5, wherein said operable air-conditioning apparatus selection means determines a maximum value of operation efficiency for each of said plurality of air-conditioning apparatuses respectively, on the basis of said performance model data, and, from said plurality of air-conditioning apparatuses, determines combination patterns of air-conditioning apparatuses to be operated and air-conditioning apparatuses to be shut down on the basis of an order of the maximum values of said operation efficiencies.

8. The air-conditioning apparatus control device of claim 7, wherein said operable air-conditioning apparatus selection means determines said combination patterns so that an air-conditioning apparatus having the greatest maximum value of said operation efficiency is included in said air-conditioning apparatuses to be operated.

9. The air-conditioning apparatus control device of claim 4, wherein said air-conditioning apparatus is provided with first temperature sensing means for sensing a temperature inside of said space subjected to air conditioning and a second temperature sensing means for sensing a temperature outside of said space subjected to air conditioning; and wherein said air conditioning capability allocation calculating means makes a correction to said performance model data on the basis of at least one of a temperature inside of said space subjected to air conditioning and a temperature outside of said space subjected to air conditioning.

10. The air-conditioning apparatus control device of claim 9, wherein each of said plurality of air-conditioning apparatuses has a refrigerant circuit in which a compressor, an outdoor heat exchanger, a throttle device, and an indoor heat exchanger are circularly connected to one another;

wherein said first temperature sensing means senses a refrigerant temperature of said indoor heat exchanger as a temperature inside of said space subjected to air conditioning;

wherein said second temperature sensing means senses a refrigerant temperature of said outdoor heat exchanger as a temperature outside of said space subjected to air conditioning; and wherein said air conditioning capability allocation calculating means obtains a correction coefficient preset according to a refrigerant temperature of said indoor heat exchanger and a refrigerant temperature of said outdoor heat exchanger and makes a correction to said performance model data in accordance with said correction coefficient.

11. The air-conditioning apparatus control device of claim 4, wherein data storage means is provided for storing information as to whether or not each of said air-conditioning apparatuses is to be subjected to control;

wherein, said overall air conditioning load calculating means determines an overall air conditioning load that is the sum of air conditioning loads of said air-conditioning apparatuses subjected to control from said plurality of air-conditioning apparatuses; and wherein, said air conditioning capability allocation calculating means determines air conditioning capability of said air-conditioning apparatuses so that the sum of air conditioning capability of said air-conditioning apparatuses subjected to control from said plurality of air-conditioning apparatuses is equal to said overall air conditioning load and that the sum of power consumption of said air-conditioning apparatuses subjected to control is minimum.

12. The air-conditioning apparatus control device of claim 4, wherein, said overall air conditioning load calculating means selects air-conditioning apparatuses having an air conditioning load smaller than a predetermined value as air-conditioning apparatuses subjected to control from among said plurality of air-conditioning apparatuses, and determines an overall air conditioning load that is the sum of air conditioning loads of said air-conditioning apparatuses subjected to control; and wherein, said air conditioning capability allocation calculating means determines air conditioning capability of said air-conditioning apparatuses so that the sum of air conditioning capability of said air-conditioning apparatuses subjected to control from said plurality of air-conditioning apparatuses is equal to said overall air conditioning load and that the sum of power consumption of said air-conditioning apparatuses subjected to control is minimum.

* * * * *